US010161217B2

(12) United States Patent
Twardowski

(10) Patent No.: US 10,161,217 B2
(45) Date of Patent: Dec. 25, 2018

(54) BALL SEAT APPARATUS AND METHOD

(71) Applicant: Weatherford Technology Holdings, LLC, Houston, TX (US)

(72) Inventor: Eric M. Twardowski, Spring, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 862 days.

(21) Appl. No.: 14/152,913

(22) Filed: Jan. 10, 2014

(65) Prior Publication Data

US 2014/0199196 A1 Jul. 17, 2014

Related U.S. Application Data

(60) Provisional application No. 61/751,932, filed on Jan. 13, 2013.

(51) Int. Cl.

| | |
|---|---|
| ***E21B 34/14*** | (2006.01) |
| ***E21B 4/02*** | (2006.01) |
| ***E21B 23/04*** | (2006.01) |
| ***E21B 33/14*** | (2006.01) |
| ***E21B 7/20*** | (2006.01) |
| ***E21B 21/10*** | (2006.01) |

(52) U.S. Cl.

CPC ..... *E21B 33/14* (2013.01); *E21B 4/02* (2013.01); *E21B 7/20* (2013.01); *E21B 21/10* (2013.01); *E21B 23/04* (2013.01); *E21B 34/14* (2013.01)

(58) Field of Classification Search

CPC . E21B 4/02; E21B 23/04; E21B 34/14; E21B 7/68

USPC ..... 166/318; 175/171

See application file for complete search history.

(56) References Cited

U.S. PATENT DOCUMENTS

| | | | | |
|---|---|---|---|---|
| 4,114,705 | A * | 9/1978 | Milan | E21B 7/18 175/231 |
| 4,893,678 | A * | 1/1990 | Stokley | E21B 33/127 166/238 |
| 5,318,118 | A * | 6/1994 | Duell | E21B 33/126 166/202 |
| 5,499,687 | A * | 3/1996 | Lee | E21B 21/003 166/154 |
| 5,733,113 | A * | 3/1998 | Grupping | E21B 4/02 175/107 |
| 6,401,813 | B1 | 6/2002 | Carmichael et al. | |
| 7,857,052 | B2 * | 12/2010 | Giroux | E21B 7/20 166/154 |
| 7,934,559 | B2 * | 5/2011 | Posevina | E21B 21/103 166/154 |

(Continued)

OTHER PUBLICATIONS

Australian Examination Report dated Feb. 25, 2016, for Australian Patent Application No. 2014205104.

(Continued)

*Primary Examiner* — Giovanna C. Wright

(74) *Attorney, Agent, or Firm* — Patterson + Sheridan, LLP

(57) ABSTRACT

A ball seat assembly includes a tubular having a bore therethrough; an entry port in fluid communication with the bore; a plurality of exit ports in fluid communication with the entry port; a ball seat disposed in the each of the plurality of exit ports, wherein the ball seat is configured to receive a ball to block fluid flow through the respective exit port; and a diverter configured to block fluid flow through the bore and direct fluid flow from the bore to the entry port.

21 Claims, 46 Drawing Sheets

(56) References Cited

U.S. PATENT DOCUMENTS

| | | | | |
|---|---|---|---|---|
| 8,448,700 | B2 * | 5/2013 | Connell | E21B 43/114 166/222 |
| 2004/0099447 | A1 * | 5/2004 | Howlett | E21B 34/14 175/317 |
| 2006/0113115 | A1 * | 6/2006 | Lee | E21B 21/103 175/317 |
| 2007/0062706 | A1 * | 3/2007 | Leising | E21B 34/14 166/379 |
| 2009/0084555 | A1 * | 4/2009 | Lee | E21B 10/322 166/319 |
| 2011/0011646 | A1 | 1/2011 | Giroux et al. | |
| 2011/0036592 | A1 * | 2/2011 | Fay | E21B 34/14 166/374 |
| 2011/0203809 | A1 * | 8/2011 | Knobloch, Jr. | E21B 21/103 166/386 |

OTHER PUBLICATIONS

Canadian Office Action dated Apr. 28, 2016, for Canadian Patent Application No. 2,896,702.
Australian Examination Report dated Feb. 14, 2017, for Australian Patent Application No. 2014205104, 4 pgs.
Canadian Office Action dated Nov. 21, 2017, for Canadian Patent Application No. 2,896,702.
EPO Office Action dated Jan. 26, 2018, for European Patent Application No. 14701891.5.

* cited by examiner

BALL SEAT APPARATUS AND METHOD

BACKGROUND OF THE INVENTION

Field of the Invention

The present invention generally relates to an apparatus and method for casing drilling. More particularly, the invention relates to a ball seat apparatus and method for casing drilling.

Description of the Related Art

In the oil and gas producing industry, the process of cementing casing into the wellbore of an oil or gas well generally comprises several steps. For example, a conductor pipe is positioned in the hole or wellbore and may be supported by the formation and/or cemented. Next, a section of a hole or wellbore is drilled with a drill bit which is slightly larger than the outside diameter of the casing which will be run into the well.

Thereafter, a string of casing is run into the wellbore to the required depth where the casing lands in and is supported by a well head in the conductor. Next, cement slurry is pumped into the casing to fill the annulus between the casing and the wellbore. The cement serves to secure the casing in position and prevent migration of fluids between formations through which the casing has passed. Once the cement hardens, a smaller drill bit is used to drill through the cement in the shoe joint and further into the formation.

Although the process of drilling with casing has improved, there is still a need for further improvements in drilling with casing techniques.

SUMMARY OF THE INVENTION

Embodiments of the present invention provide a casing bit drive assembly suitable for use with a casing drilling system. The casing bit drive assembly may include one or more of the following: a retrievable drilling motor; a decoupled casing sub including a drilling member such as a casing bit; a releasable coupling between the motor and drilling member; a releasable coupling between the motor and casing; a cement diverter; and a drilling member.

The motor may also include features for cementing either around or through the drilling motor. In one embodiment, a cement diverter mechanism is used to alter the flow path for cementing purposes. Separate flow paths are available for drilling fluid flow during drilling mode and cement flow during cementing mode. These features limit the chances of inadvertently cementing the motor in place. In another embodiment, the power section of the drilling motor is sealed off prior to pumping cement, in order to prevent damage to the power section from hardened cement.

In one embodiment, a ball seat assembly includes a tubular having a bore therethrough; an entry port in fluid communication with the bore; a plurality of exit ports in fluid communication with the entry port; a ball seat disposed in the each of the plurality of exit ports, wherein the ball seat is configured to receive a ball to block fluid flow through the respective exit port; and a diverter configured to block fluid flow through the bore and direct fluid flow from the bore to the entry port.

In another embodiment, an apparatus for controlling fluid flow through a tubular includes the tubular having a bore therethrough; an inlet in fluid communication with the bore, the inlet having a plurality of outlets; and a diverter configured to block fluid flow through the bore and direct fluid flow through the inlet, wherein the total flow area of the plurality of outlets is more than the flow area of the inlet.

In another embodiment, a method of controlling fluid flow through a tubular includes flowing a fluid through a bore of the tubular; directing the fluid in the bore to flow through an entry port; flowing the fluid out of the entry port through a plurality of exit ports; and blocking flow through each of the plurality of exit ports.

In another embodiment, a method of operating a motor assembly having a power section includes flowing a fluid through a bore of the power section; directing the fluid in the bore to flow through an entry port; flowing the fluid out of the entry port through a plurality of exit ports; and operating the power section using the fluid from the plurality of exit ports.

In one embodiment, a casing drilling system includes a casing; a drilling member coupled to the casing; a retrievable motor releasably coupled to the casing and includes a power section configured to rotate the drilling member relative to the casing; and a cement diverter for diverting cement from the power section of the drilling motor.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIGS. 15-18 are enlarged views of the motor.

FIG. 26 is an enlarged, partial view of FIG. 25.

FIG. 31B is an enlarged, partial view of FIG. 31A.

FIG. 32B is an enlarged, partial view of FIG. 32A.

FIG. 33B is an enlarged, partial view of FIG. 33A.

DETAILED DESCRIPTION

Embodiments of the present invention generally relates to a casing drilling system. In one embodiment, the system includes a conductor casing coupled to a surface casing and the coupled casings can be run concurrently. In one trip, the system will jet-in the conductor casing and a low pressure wellhead housing, unlatch the surface casing from the conductor casing, drill the surface casing to target depth, land a high pressure wellhead housing, cement, and release. The system includes a drill bit that may be powered by a retrievable downhole motor which rotates the drill bit independently of the surface casing string. In another embodiment, the system may also include the option of rotating the drilling bit from surface.

An exemplary casing drilling method is disclosed in U.S. patent application Ser. No. 12/620,581, which application is incorporated herein in its entirety.

An exemplary subsea casing drilling system is disclosed in U.S. provisional patent application Ser. No. 61/601,676 ("the '676 application"), filed on Feb. 22, 2012, which application is incorporated herein by reference in its entirety.

The '676 application discloses an embodiment of a casing bit drive assembly suitable for use in a casing drilling system and method. The casing bit drive assembly includes one or more of the following: a retrievable drilling motor; a decoupled casing sub; a releasable coupling between the motor and casing bit; a releasable coupling between the motor and casing; a cement diverter; and a casing bit.

Figure 1A:
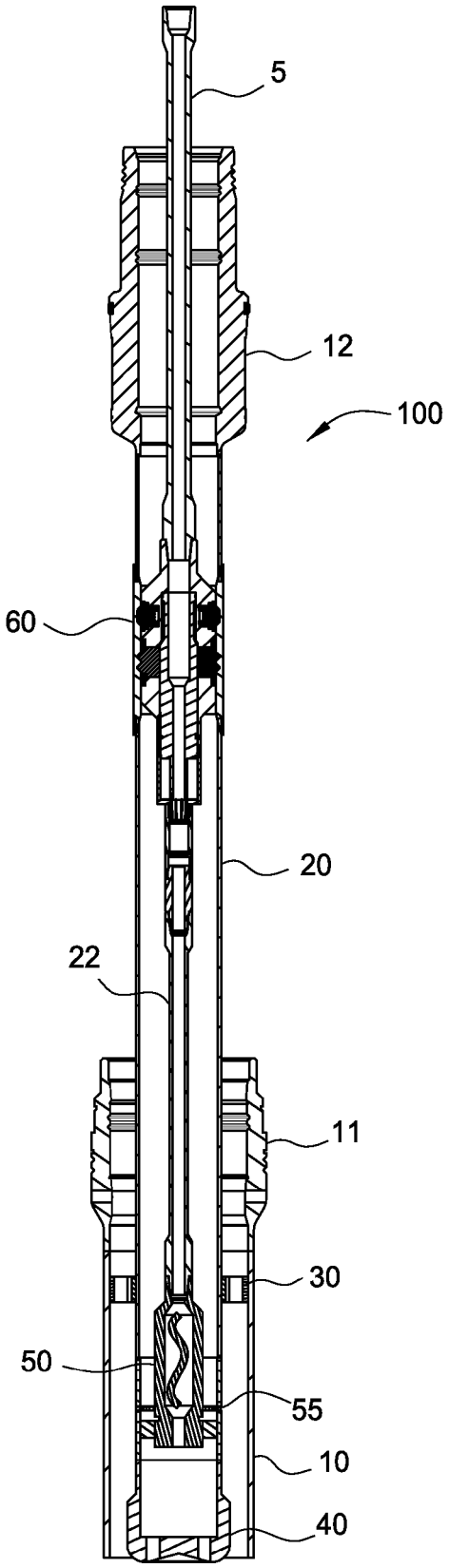
FIGS. 1A and 1B show an exemplary embodiment of a casing drilling system.
Figure 1B:
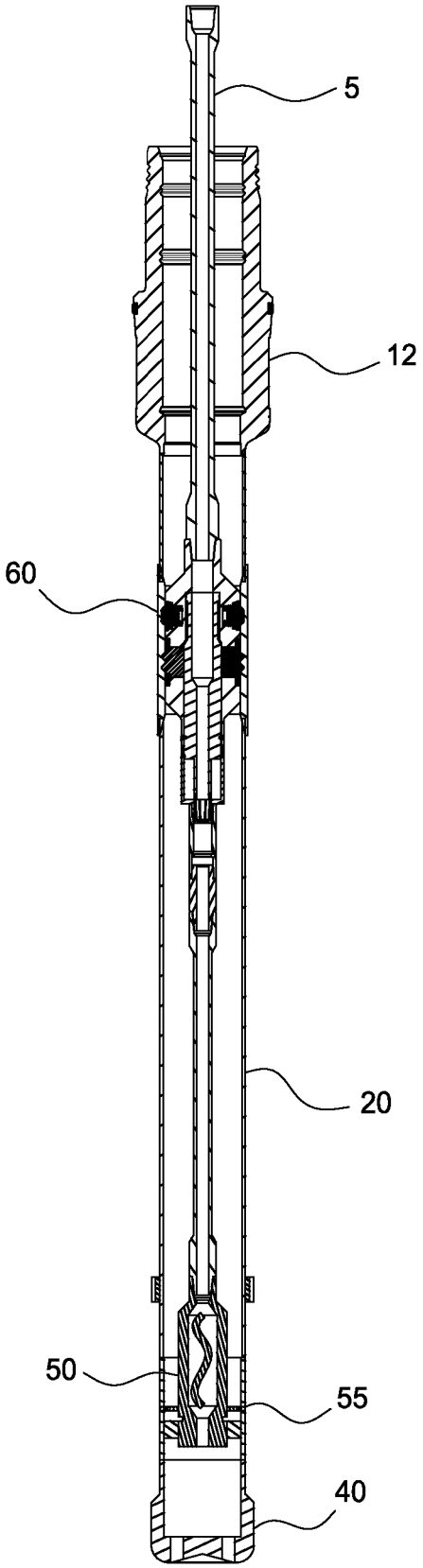

FIGS. 1A and 1B show an exemplary embodiment of a casing drilling system 100. The casing drilling system 100 includes a conductor casing 10 coupled to a surface casing 20 and the coupled casings 10, 20 may be run concurrently. The casings 10, 20 may be coupled using a releasable latch 30. A high pressure wellhead 12 connected to the surface casing 20 is configured to land in the low pressure wellhead 11 of the conductor casing 10. The drill string 5 and the inner string 22 are coupled to the surface casing 20 using a running tool 60. A motor 50 is provided at the lower end of the inner string 22 to rotate the casing bit 40. In another embodiment, the casing bit 40 may be rotated using torque transmitted from the surface casing 20. An optional swivel 55 may be included to allow relative rotation between the casing bit 40 and the surface casing 20. In operation, the casing drilling system 100 is run-in on the drillstring 5 until it reaches the sea floor. The system 100 is then "jetted" into the soft sea floor until the majority of the length of the conductor casing 10 is below the mudline, with the low pressure wellhead housing 11 protruding a few feet above the mudline. The system 100 is then held in place for a time, such as a few hours, to allow the formation to "soak" or re-settle around the conductor casing 10. After "soaking", skin friction between the formation and the conductor casing 10 will support the weight of the conductor casing 10.

The releasable latch 30 is then deactivated to decouple the surface casing 20 from the conductor casing 10. In one embodiment, the surface casing 20 has a 22 inch diameter and the conductor casing 10 has a 36 inch diameter. After unlatching from the conductor casing 10, the surface casing 20 is drilled or urged ahead. The casing bit 40 is rotated by the downhole drilling motor 50 to extend the wellbore. The decoupled drilling swivel 55 allows the casing bit 40 to rotate independently of the casing string 20 (although the casing string may also be rotated from surface). Upon reaching target depth ("TD"), the high pressure wellhead 12 is landed in the low pressure wellhead housing 11. Since the casing string 20 and high pressure wellhead 11 do not necessarily need to rotate, drilling may continue as the high pressure wellhead 12 is landed, without risking damage to the wellhead's sealing surfaces.

After landing the wellhead 12, it is likely that the formation alone will not be able to support the weight of the surface casing 20. If the running tool 60 was released at this point, it is possible that the entire casing string 20 and wellhead 12 could sink or subside below the mudline. For this reason, the running tool 60 must remain engaged with the surface casing 20 and weight must be held at surface while cementing operations are performed. After cementing, the running tool 60 continues holding weight from surface until the cement has cured sufficiently to support the weight of the surface casing 20.

After the cement has cured sufficiently, the running tool 60 is released from the surface casing 20. The running tool 60, inner string 22, and drilling motor 50 are then retrieved to surface.

A second bottom hole assembly ("BHA") is then run in the hole to drill out the cement shoe track and the drillable casing bit 40. This drilling BHA may continue drilling ahead into new formation.

The embodiments described below illustrate several concepts for the bit drive assembly. Some of the features are common to multiple concepts. It is contemplated that features described in one concept is not limited for use with that concept, but may be used with another concept.

Figure 2:
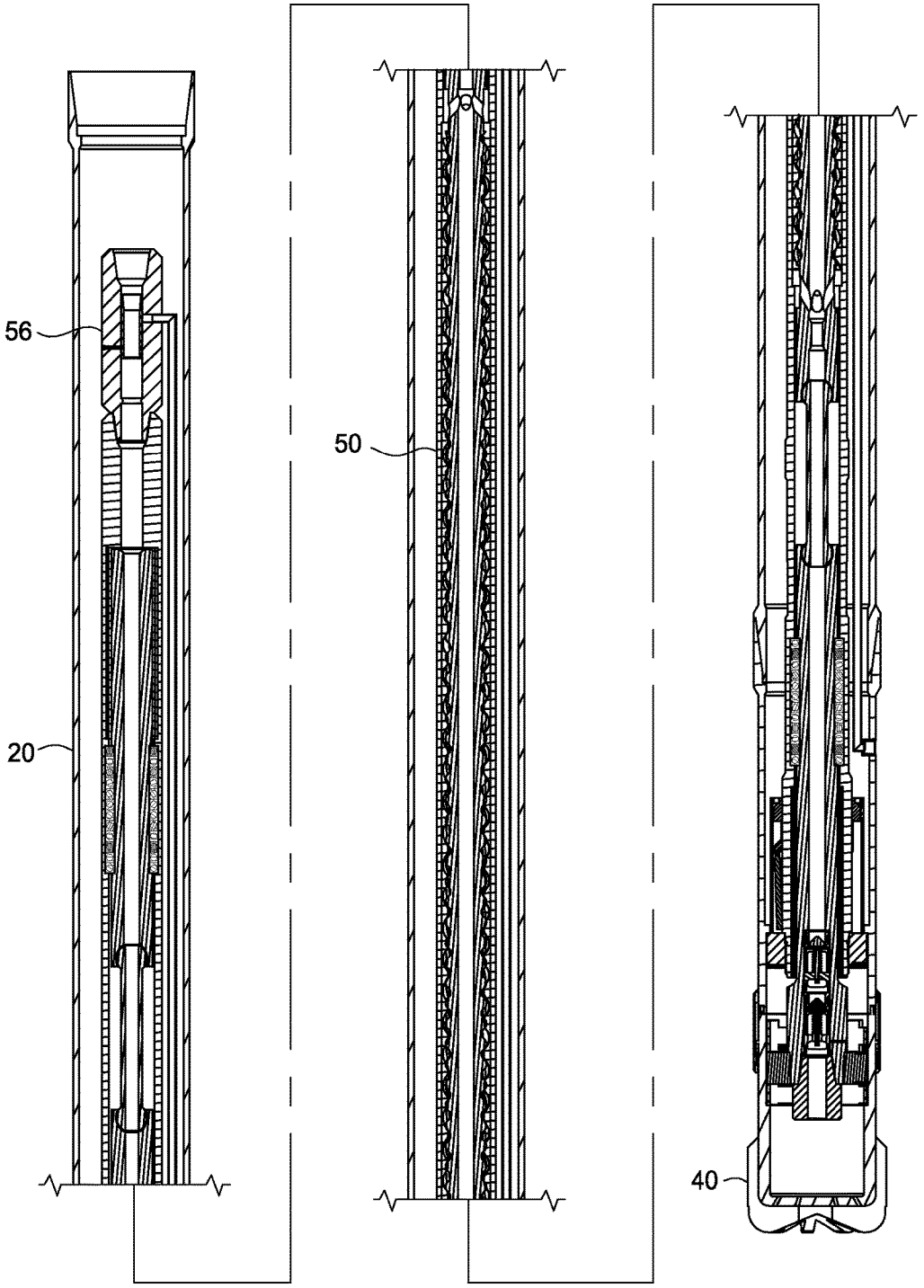
FIG. 2 illustrates an embodiment of a casing drilling system without the conductor casing.

FIG. 2 illustrates an embodiment of a casing drilling system 100 without the conductor casing 10. FIGS. 3-7 are enlarged partial views of FIG. 1. The surface casing 20 (e.g., 22 inch casing) includes an inner string 22 disposed therein. Connected below the inner string 22 are a diverter sub 56, a drilling motor 50, and a motor output shaft 62. The motor output shaft 62 is configured to rotate a casing bit 40 relative to the surface casing 20.

In one embodiment, a drilling motor 50 includes features to flow cement around the motor 50, as opposed to through the motor 50. This limits the possibility of inadvertently cementing the motor 50 in place. Since no cement is pumped through the motor 50, it is unlikely that the expensive motor 50 components will be damaged as a result of hardened cement remaining inside the motor 50. The bypass around the motor 50 may cause the cement to enter the annulus at a short distance such as a few feet above the casing bit 40.

Figure 3:
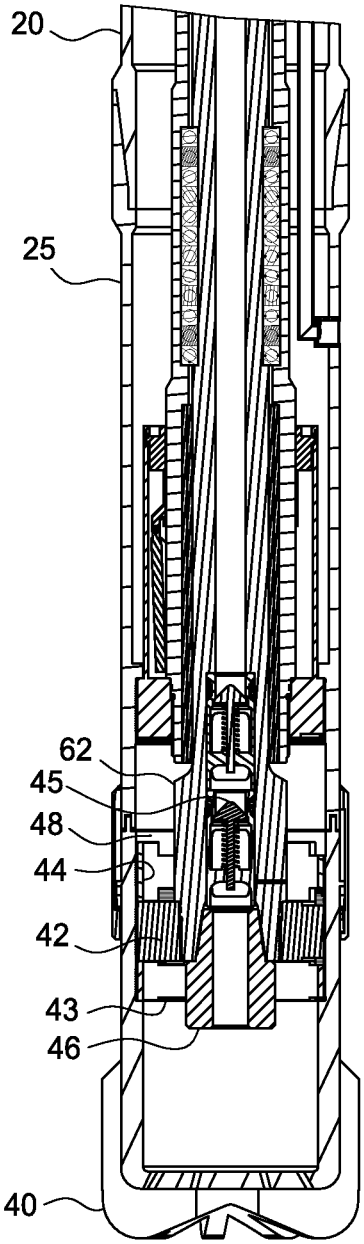
FIGS. 3-7 are enlarged partial views of FIG. 1.
Figure 4:
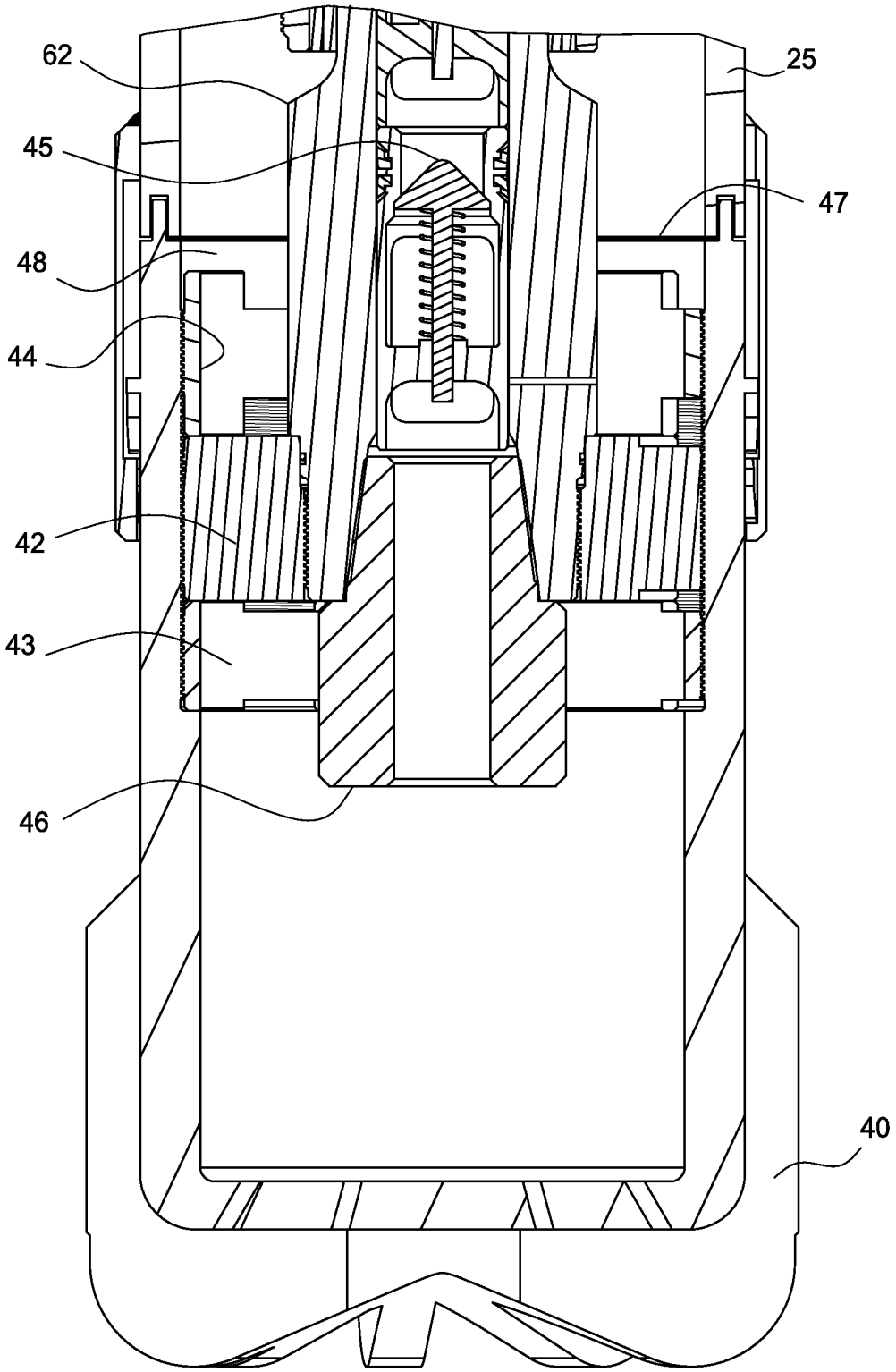

Referring to FIGS. 3 and 4, the lower end of the bit drive assembly contains a drillable casing bit 40. An exemplary casing bit 40 suitable for use with this and other concepts described herein or illustrated in the Figures is Weatherford's Defyer DPA casing bit. The casing bit 40 is coupled to the motor output shaft 62 by a threaded aluminum (or other drillable material) coupling 42. Threads on the outer diameter ("OD") of the coupling 42 are secured to the casing bit 40. The threads on the inner diameter ("ID") of the coupling 42 are secured to the motor output shaft 62. These threaded connections allow for transmission of axial and torsional drilling loads. The ID threads on the coupling 42 are designed to be weaker than the threads on the OD of the coupling 42. For example, the ID threads may have a shorter length than the OD threads. In another example, the ID threads may have a smaller diameter. In this respect, the weaker ID threads will shear before the OD threads. Since the threads are made from aluminum, the motor 50 may be retrieved by pulling it upward with overpull force and shearing the aluminum threads. The motor 50 can be retrieved, while the coupling 42 remains behind.

A spacer ring 43 is used to facilitate assembly of the bit drive assembly. The height of this spacer 43 can be selected to easily adjust the axial space-out distance between the casing bit 40 and the motor output shaft 62.

A threaded locking ring 44 is positioned above the aluminum coupling 42. It may be used as a jam-nut to effectively prevent the OD threads on the coupling 42 from loosening during the drilling process.

Drilling float valves 45 are installed in the bore of the motor output shaft 62. As shown, a tandem set of float valves 45 are used, although one or three or more float valves may be used. The float valves 45 provide a pressure barrier to prevent u-tubing of drilling fluid or cement, when the pumps are not circulating fluid down the drillstring. A stop sub 46 is threaded into the bottom of the output shaft 62. This sub 46 prevents the float valve(s) 45 from falling out.

The upper end of the casing bit 40 does not come into direct contact with the casing sub 25. A small clearance gap 47 is present between these two components 25, 40. An optional rotating sealing element could be positioned in this gap 47. In one embodiment, the gap 47 may include a "leaking trash barrier". This trash barrier includes a tortuous path or labyrinth geometry. The trash barrier will allow fluid to leak through it, but larger particles such as formation cuttings, cannot freely cross through this barrier.

To further aid in preventing formation cuttings from entering this gap 47, a positive pressure port may be used. This port directs a small portion of the drilling fluid into the cavity 48 above the aluminum coupling 42. In this manner, pressure and fluid flow is constantly directed to travel from inside the cavity to the borehole annulus. This positive pressure and flow makes it less likely that formation cuttings can enter from the borehole annulus.

Figure 5:
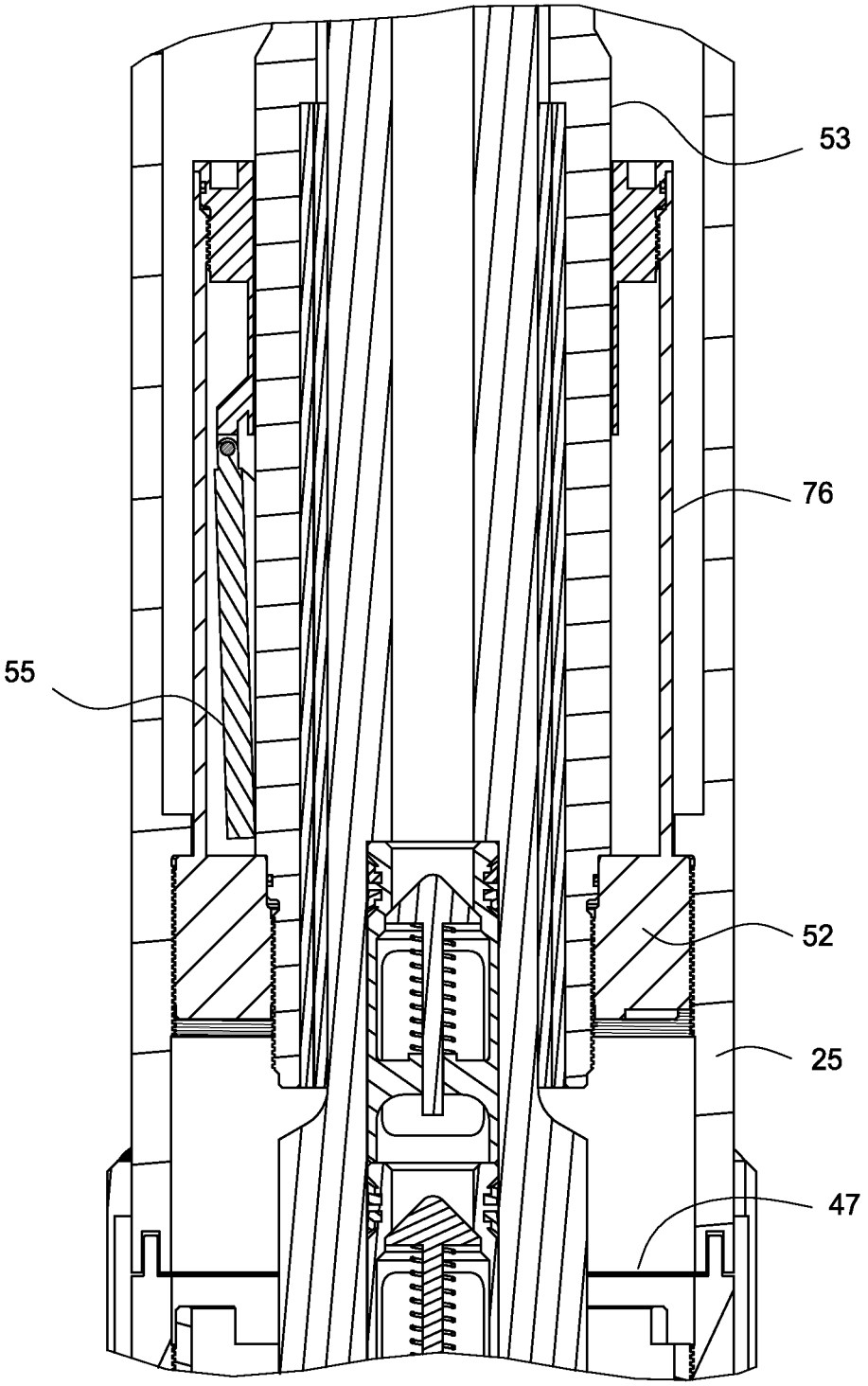

As shown in FIG. 5, a second drillable coupling 52 is used to releasably connect the motor housing 53 to the non-rotating casing sub 25. Similar to the first, lower coupling 42, this upper coupling 52 has threads on the OD and ID for transmitting axial and torsional loads. Threads on the OD of the coupling 52 are secured to the non-rotating casing sub 25. The threads on the ID of the coupling 52 are secured to the motor housing 53. The ID threads on the coupling 52 are designed to be weaker than the threads on the OD of the coupling 52, as discussed above. Since the threads are made from aluminum, the motor 50 may be retrieved by pulling it upward with overpull force and shearing-out the aluminum threads. The motor 50 can be retrieved, while the coupling 52 remains behind.

A secondary flapper float valve 55 is positioned above the upper coupling 53. The flapper float valve 55 may be similar in form to a downhole deployment valve. The float valve 55 may be integral to the upper coupling 52 via an extension sleeve 76 as shown below to facilitate assembly. However, this flapper float valve 55 may also be completely separate from the upper coupling 52.

The flapper of the float valve 55 is held in the open position while the motor 50 is installed. The motor 50 is positioned such that it passes through the bore of the float valve 55, thus preventing the spring loaded flapper from pivoting to the closed position. The secondary float valve 55 remains in the open position during the drilling and cementing processes.

Figure 6:
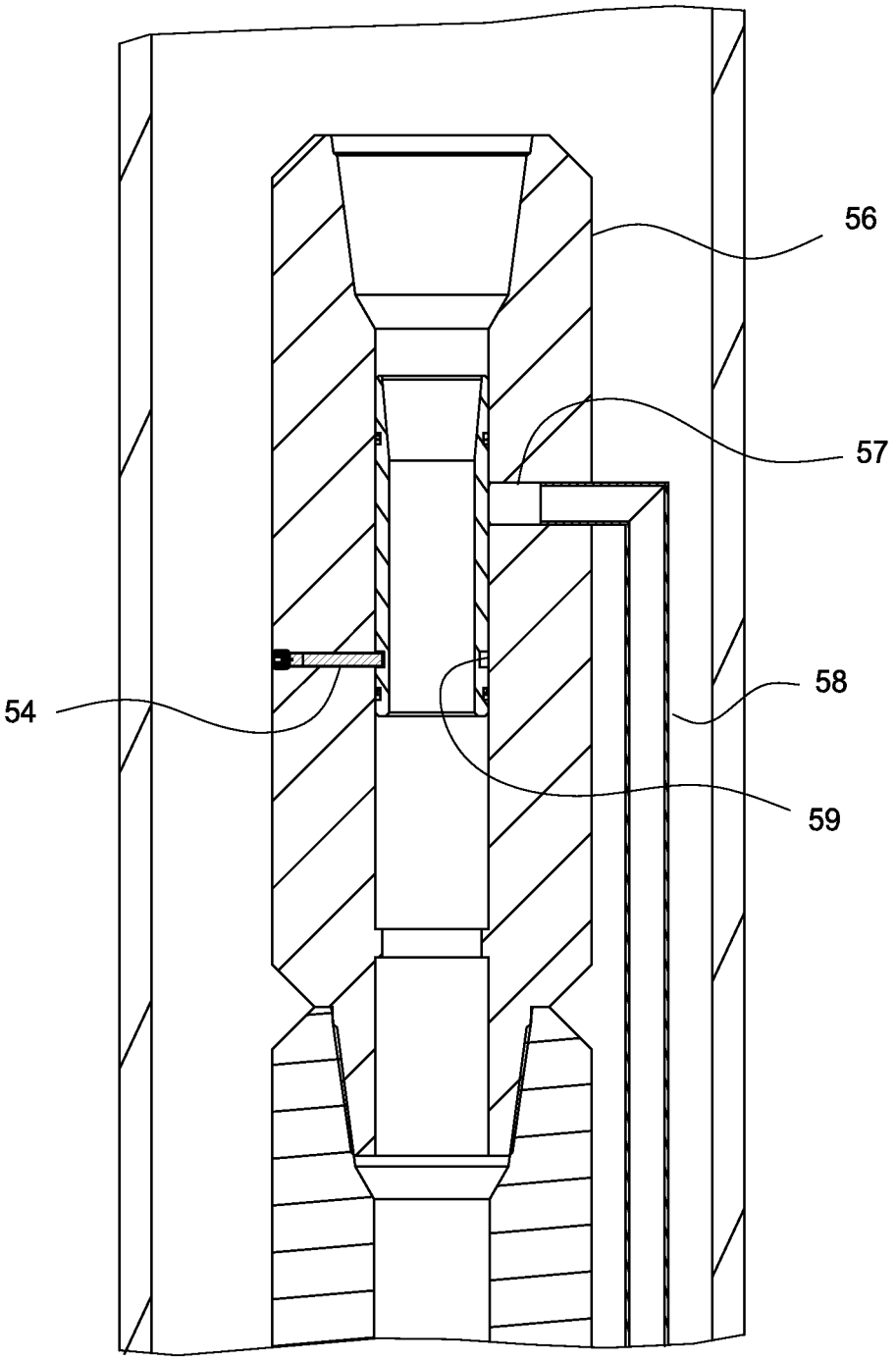

After drilling to target depth ("TD") and landing the high pressure wellhead 12, the cementing process can begin. Prior to pumping cement, the flow path in the bit drive assembly is changed, so that cement flow will be directed around the drilling motor 50 as opposed to through the drilling motor 50. In one embodiment, a diverter mechanism is installed on the top of the motor 50, as shown in FIG. 6. The diverter mechanism includes a diverter sub 56 that is connected to the inner string 22. The diverter sub 56 has cementing side port 57 that is in selective communication with the bore of the diverter sub 56, as shown in FIG. 6. A cementing tube 58 is connected to the side port 57 and extends downward around the motor 50. In drilling mode, the side port 57 and the cementing tube 58 are blocked by a sleeve 59. The sleeve 59 is held in position using a shearable member such as a screw 54. In this manner, the fluid flow is directed through the bore of the diverter sub 56 to the motor 50.

Figure 8:
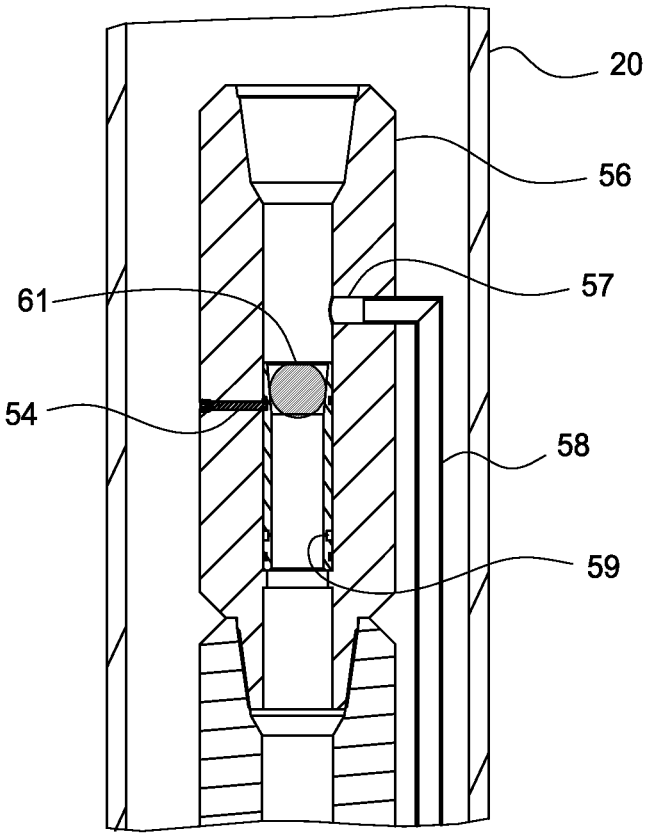
FIG. 8 shows a sequence view of the diverter mechanism in operation.

When ready to cement, a ball 61 is dropped from surface. FIG. 8 shows the ball 61 landing in the ball seat of the sleeve 59. Increasing pressure shears the shear screw 54, thereby allowing the sleeve 59 to move downward. Movement of the sleeve 59 opens the cementing port 57 and allows cement to enter the cementing tube 58. While at the same time, the ball 61 prevents cement from entering the motor 50.

Figure 7:
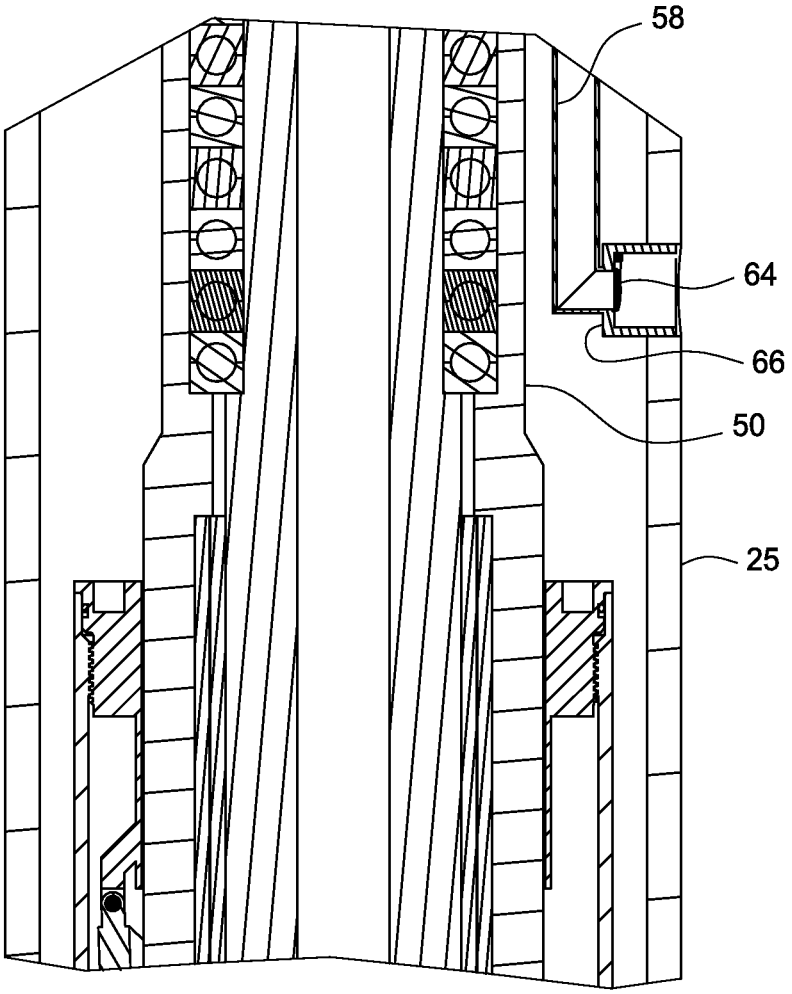

Cement is then pumped down the drillstring 5, through the inner string 22, and into the cementing tube 58. The cementing tube 58 extends downward and exits the casing sub 25 near the lower end of the motor 50, as shown in FIG. 7. The cementing tube 58 provides a path for cement to bypass the motor 50 and enter the annulus between the casing 20 and the borehole.

To prevent u-tubing of the cement, an optional small flapper float 64 is positioned near the outlet of the cementing tube 58, as shown in FIG. 7. An optional rupture disc (not shown) may be positioned between the flapper 64 and the OD of the surface casing 20 in order to prevent cuttings debris from accumulating in this space, which might hinder opening of the flapper 64.

It should be noted that the cementing tube 58 may be constructed of a rigid material (such as metal tubing) or a flexible material (such as a high pressure hose).

Figure 9:
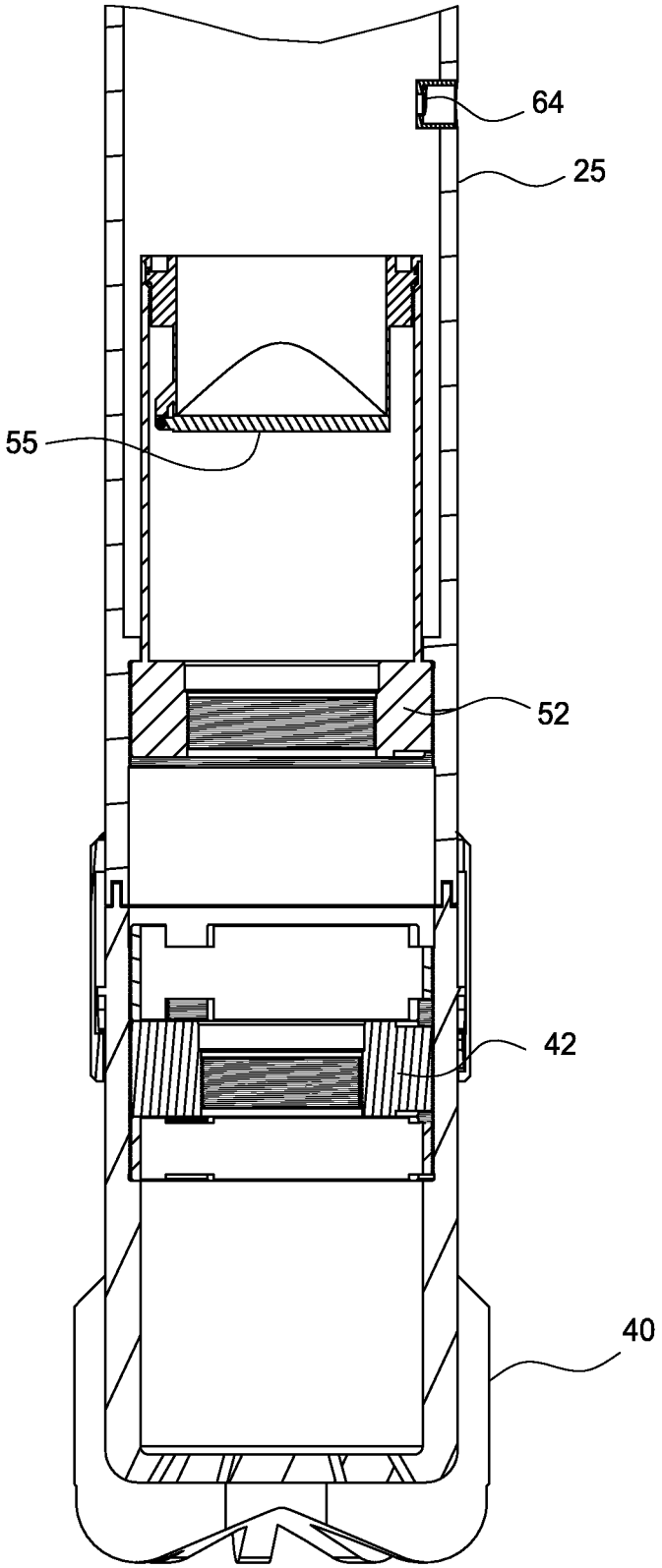
FIG. 9 shows the motor removed from the casing drilling system.

After cementing, it is desirable that the majority of the cementing tube 58 is retrieved to surface along with the drilling motor 50. In one embodiment, the lower end of the cementing tube 58 is designed to have a releasable "weak point" 66 above the flapper float 64 to facilitate shearing of the cementing tube 58 from at the lower end. As the motor 50 is retrieved, the cementing tube 58 will detach at this weak point 66. The upper end of the cementing tube 58 is retrieved with the motor 50, while the small flapper float 64 is left behind. FIG. 9 shows the motor 50 removed from the casing drilling system 100.

After drilling and cementing operations are completed, the motor 50 is retrieved up through the secondary flapper float valve 55. Once the motor 50 is no longer holding the float valve 55 in the open position, the spring loaded flapper is free to pivot to the closed position. The secondary flapper float valve 55 remains in place after the motor 50 is retrieved and acts as a secondary pressure barrier. This barrier feature may act as a safety feature such as in the event of a poor quality cement job at the casing shoe.

After the motor 50 is retrieved, the casing bit 40 is no longer coupled to the casing sub 25. In ideal conditions, a good cement job at the casing shoe will prevent the casing bit 40 from spinning freely as it is drilled-out in subsequent operations. If the casing bit 40 is not rotationally constrained, the drill-out process may be problematic. In the event of a poor quality cement job, or "wet shoe", the casing drilling system includes a mechanical feature that provides a contingency mechanism for rotationally locking the casing bit 40 to the casing sub 25. Locking these two components allows the casing bit 40 to be drilled-out more easily, since rotation of the casing bit 40 is prevented.

Figure 10:
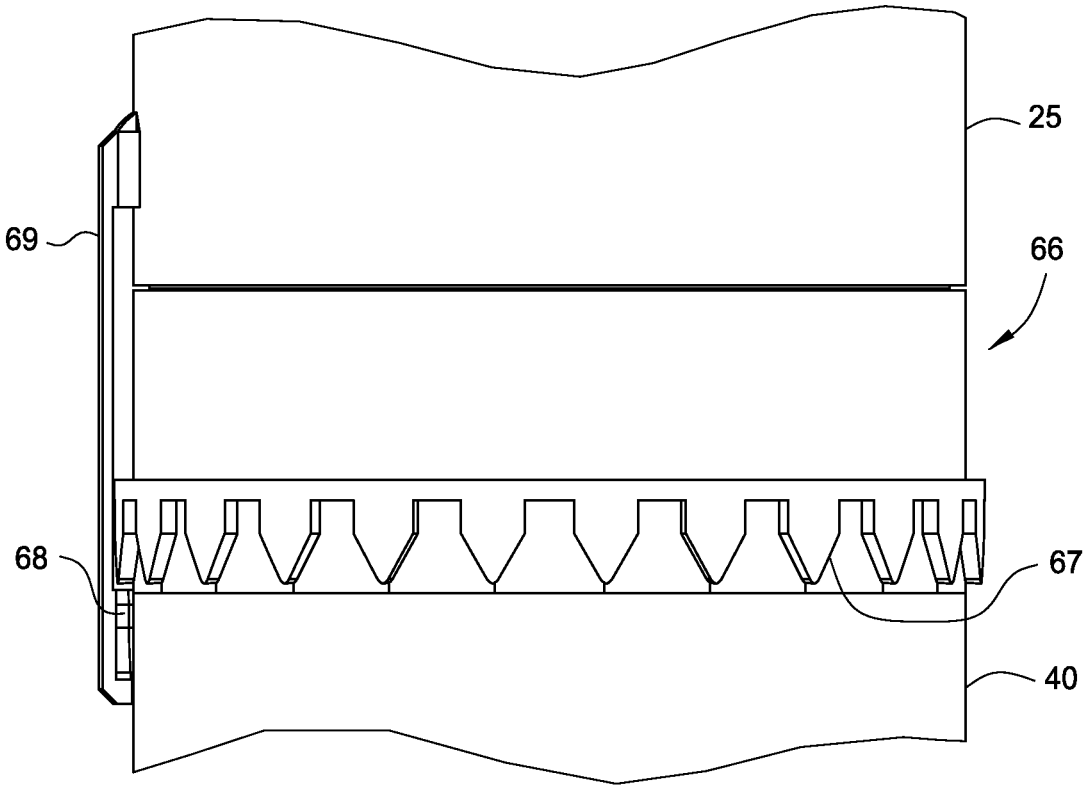
FIG. 10 illustrates an embodiment of a locking mechanism.

Referring now to FIG. 10 the mechanical feature includes a lock 66 having mating teeth 67, 68. One set of teeth 67 is provided in the OD of the casing bit 40, such as by machining the teeth 67 into the OD. Mating teeth 68 are provided on locking segments 69 that are preferably attached to the non-rotating casing sub 25. For example, the locking segments 69 may be welded to the non-rotating casing sub 25. As shown, three locking segments 69 are used, however, any suitable number, such as two or four, of segments may be used. The mating teeth 68 may be machined onto the locking segments 69.

The teeth 67 on the casing bit 40 and the teeth 68 on the locking segment 69 are arranged such that an axial gap is present between the two sets of teeth 67, 68 when the motor 50 is installed. The gap prevents the two sets of teeth 67, 68 from coming in contact (and locking the casing bit 40) as the surface casing 20 is drilled in place. After the motor 50 is retrieved, the casing bit 40 can move downward so that the locking teeth 67 on the casing bit 40 move toward the locking teeth 68 on the locking segment 69. After closing the gap, the two sets of teeth 67, 68 come in contact, thereby rotationally locking the casing bit 40 for drill-out.

In instances where the cutting structure of the casing bit 40 is resting on firm formation, an axial gap between the teeth 67, 68 may still be present, even after the motor 50 is retrieved. It is anticipated that during the subsequent drill-out operation, the drill-out bit would contact the internal face of the drillable casing bit 40. As weight on bit is applied to the drill-out bit, it would urge the casing bit 40 deeper, possibly causing the casing bit 40 to drill a small amount of new formation, perhaps only a fraction of one inch. This would allow the casing bit 40 to move downward slightly, so that the locking teeth 67, 68 would eventually come in contact and prevent further rotation of the casing bit 40. After rotational locking is achieved, the casing bit 40 can be easily drilled out with the drill-out bit.

Figure 11:
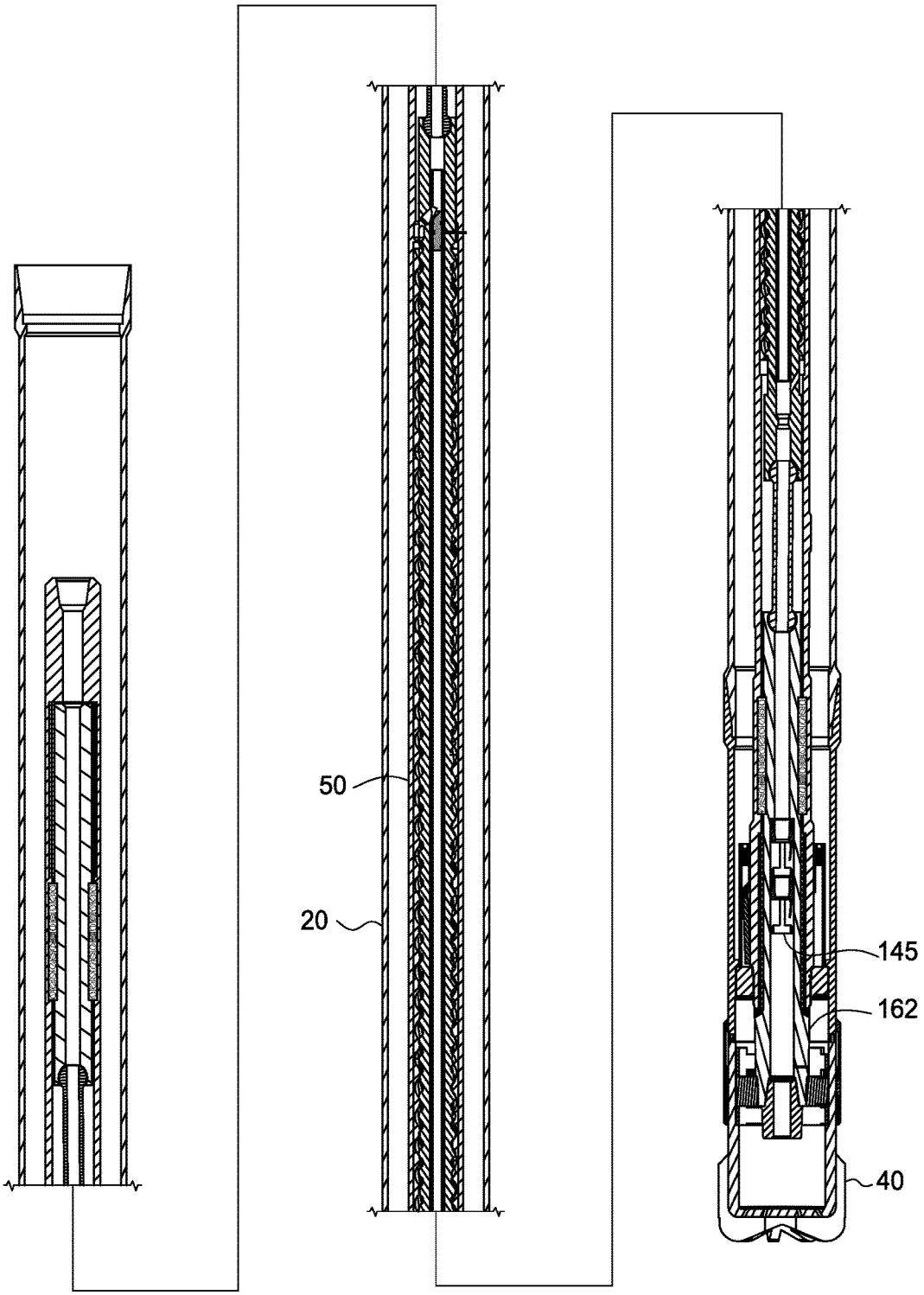
FIG. 11 illustrate another embodiment of a casing bit drive assembly.

FIG. 11 illustrate another embodiment of a casing bit drive assembly. This embodiment contains many similarities to the embodiment shown in FIG. 2. Therefore, for sake of clarity, only the differences will be discussed below. In must be noted that features taught in one or more embodiment described herein may be suitably used with another other embodiment described herein. FIGS. 12-18 illustrate enlarged partial views of FIG. 11. The casing bit drive assembly contains features that allow for cementing through the drilling motor 50 as opposed to cementing around the motor 50. In one embodiment, the cement travels through the motor 50 and into the cavity below the motor 50. The cement then exits the nozzles in the casing bit 40 and enters the annulus between the casing 20 and the borehole.

Figure 12:
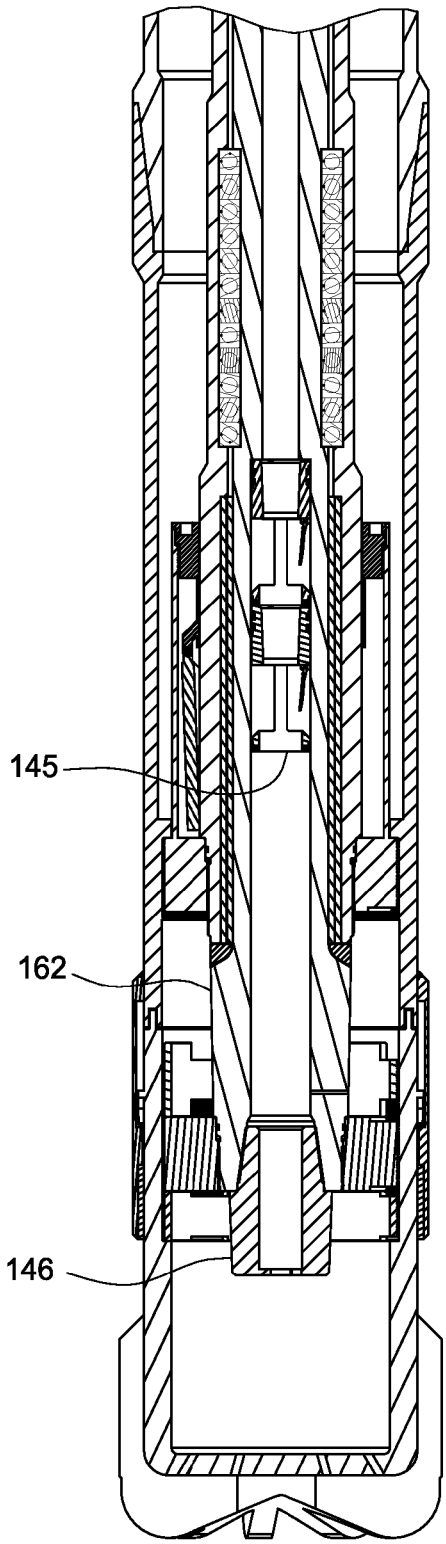
FIGS. 12-18 illustrate enlarged partial views of FIG. 11.
Figure 13:
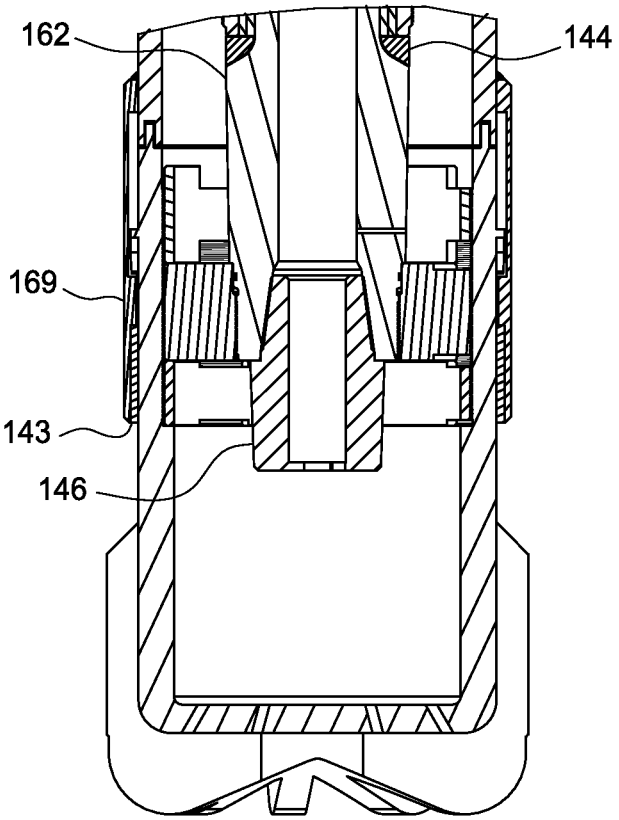
Figure 14:
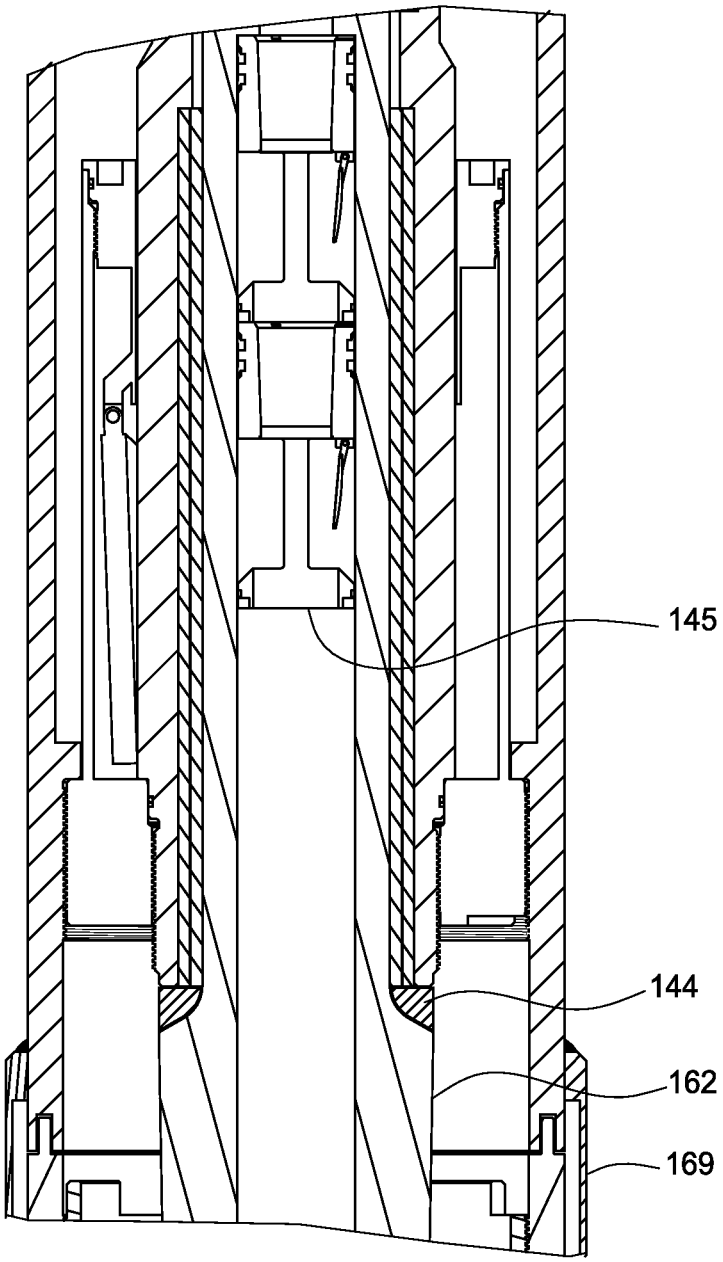
Figure 15:
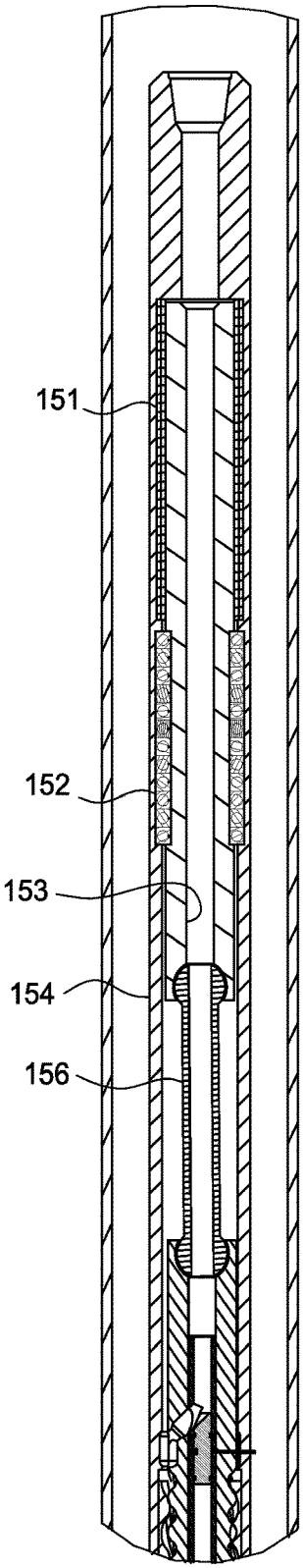

In order to prevent the lower end of the motor 50 from getting stuck in the cement, the casing bit drive assembly shown in FIGS. 12-14 is provided with one or more of the following features: tapered OD on the stop sub 146, tapered OD on the motor output shaft 162, and a ring 144 around the neck of the motor output shaft 162. In addition, these surfaces may optionally be coated with a non-stick surface treatment. Exemplary coating material includes Teflon, Impreglon, quench polish quench, and combinations thereof. The non-stick treatment will allow the outer portions of the motor 50 exposed to cement to be more easily retrieved.

The tandem drilling float valves in the bore of the output shaft 162 have been changed from plunger-type float valves to flapper-type float valves 145. The flapper float valves 145 will allow balls, pistons, and other larger components to pass through and exit the hollow bore motor 50, before getting trapped in the stop sub 146 at the lower end of the motor 50.

A marine-type radial bearing 143 may be provided on the ID of the non-rotating locking sleeve segments 169, as shown in FIG. 13. This bearing 143 rides against the OD of the rotating casing bit 40. In one embodiment, the bearing 143 may be molded into the locking sleeve segments 169. The bearing 143 provides added radial support to the casing bit 40 during the drilling process. Although the marine bearing 143 does not provide a true sealing surface, it will help prevent formation cuttings in the borehole from entering the assembly.

Figure 16:
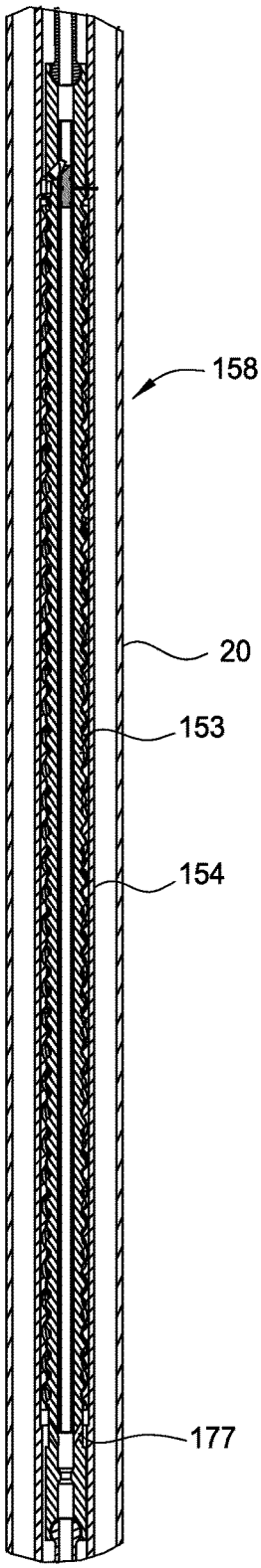
Figure 17A:
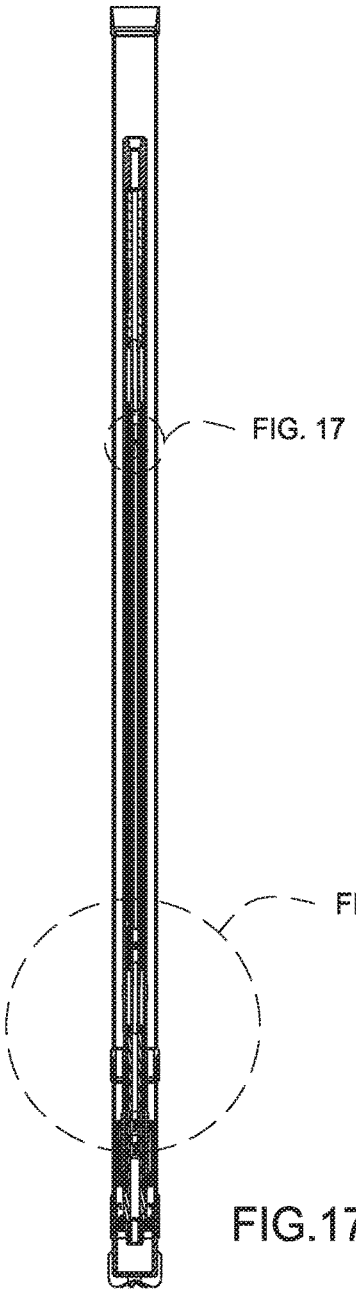
FIG. 17A is a cross-sectional view of the casing bit drive assembly.
Figure 17:
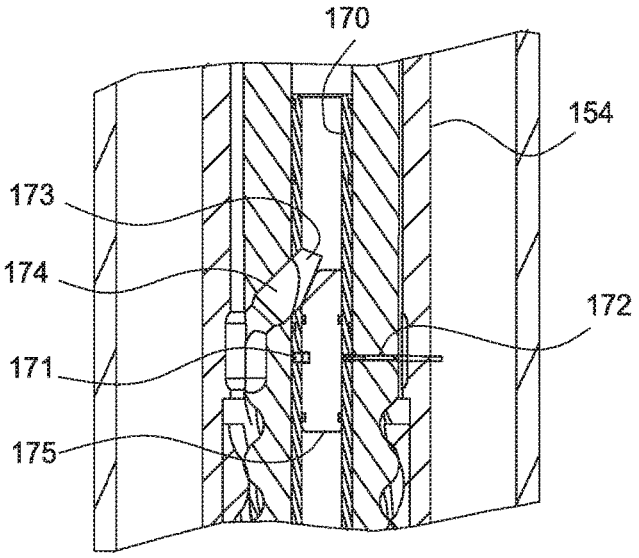

FIGS. 15-18 are enlarged views of the motor 50. The top of the motor 50 connects to the inner string 22. The upper portion of the rotor 153 is coupled to the stator 154 using axial and radial bearings 151, 152. An optional upper flex shaft 156 couples the bearing section to the power section 158 of the rotor 153. The power section 158 of the rotor 153 has a hollow bore extending therethrough. Referring to FIG. 17, a flow tube 170 and a diverter piston 175 are disposed in the bore. The diverter piston 175 is held in the flow tube 170 using a first shearable member 171 and blocks fluid flow through the flow tube 170. The flow tube 170 is held in the bore using a second shearable member 172. The second shearable member 172 is configured to shear at a lower force than the first shearable member 171. In drilling mode, the drilling fluid enters the top of the drilling motor 50. Ports 173 in the tube 170 are aligned with entry ports 174 in the rotor 153. When these ports 173, 174 are aligned, the ports 173, 174 are in the open position to allow flow to enter the top portion of the power section 158 between the OD of the rotor 153 and the ID of the stator 154. This provides power to cause rotation of the rotor 153. The diverter piston 175 prevents fluid from travelling down through the bore of the flow tube 170.

Figure 18:
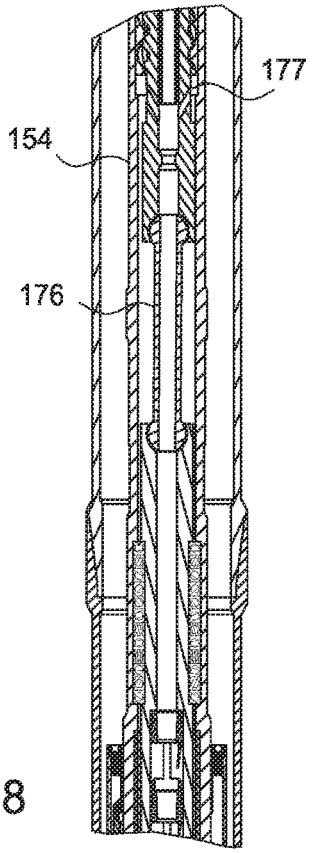

As shown in FIGS. 16 and 18, at the lower end of the power section 158, fluid flow can exit the power section 158 and re-enter the bore via port 177 to continue flowing downward to the motor output shaft 162. The lower end of the rotor 153 also includes an optional lower flex shaft 176 to facilitate transfer of torque to the output shaft 162 and includes axial and radial bearings.

Figure 19:
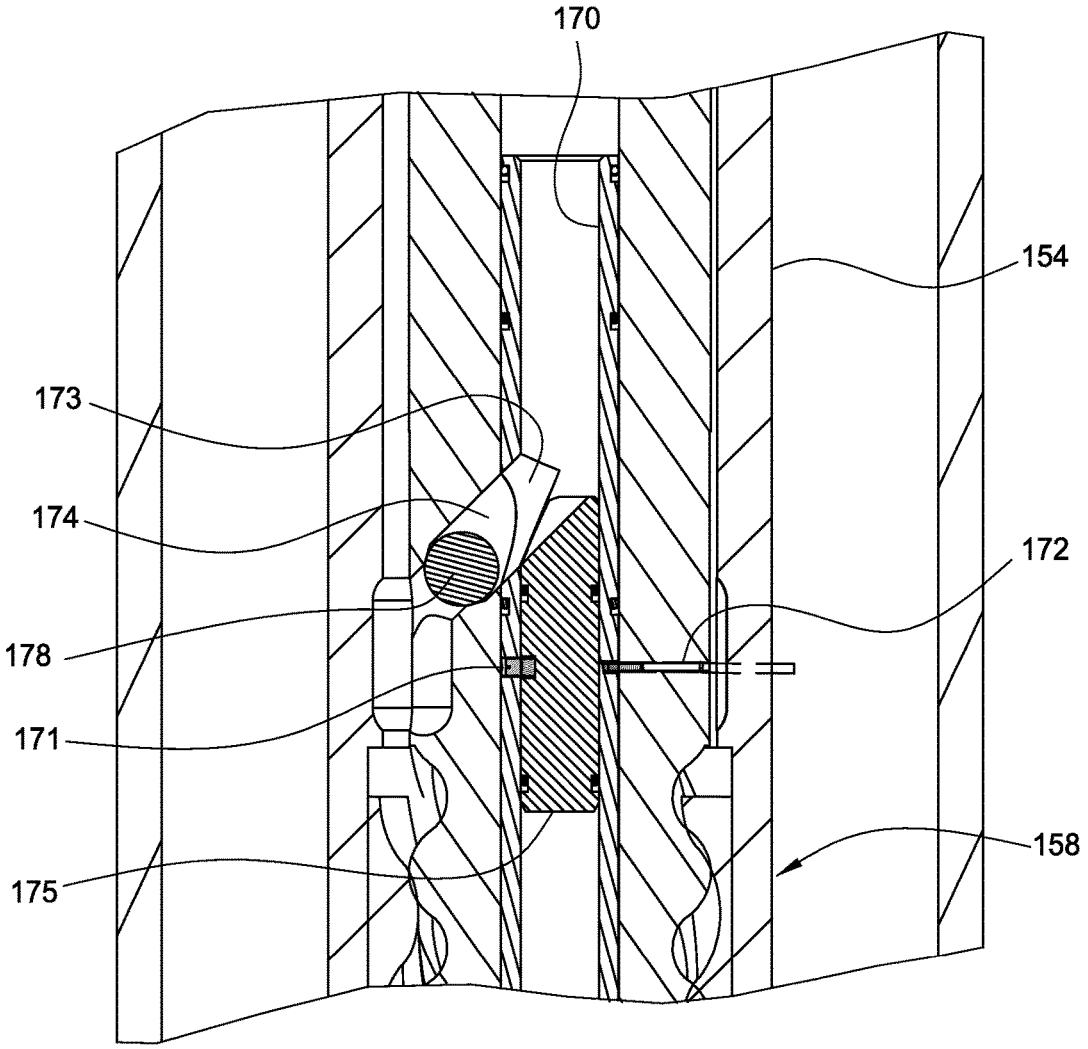
FIGS. 19-23 are sequential views of the diverter mechanism of FIG. 11 in operation.
Figure 20A:
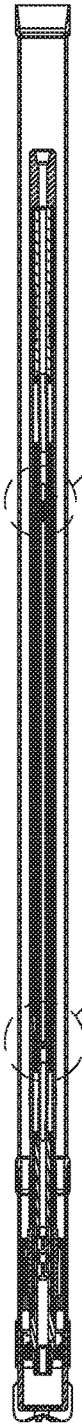
FIGS. 20A and 22A are sequential views of the casing bit drive assembly.
Figure 20:
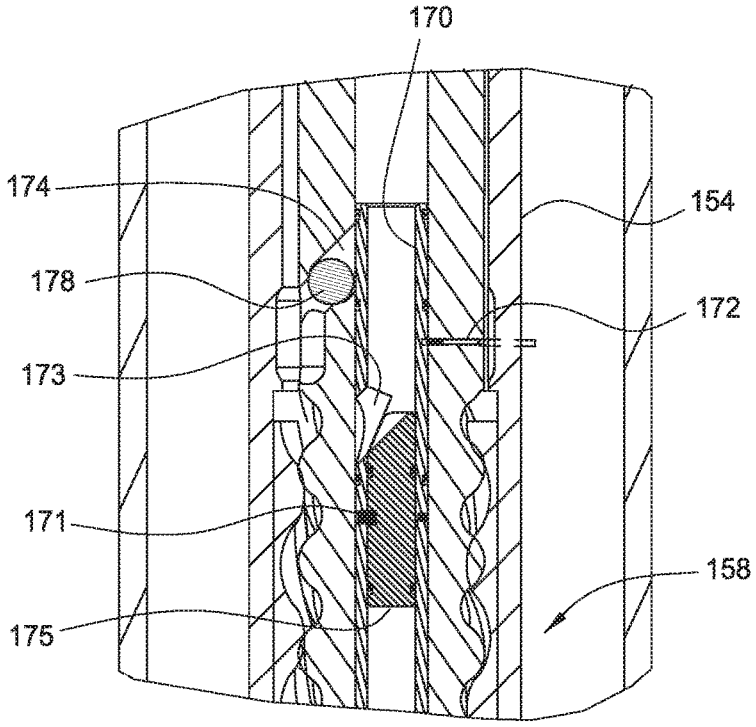
Figure 21:
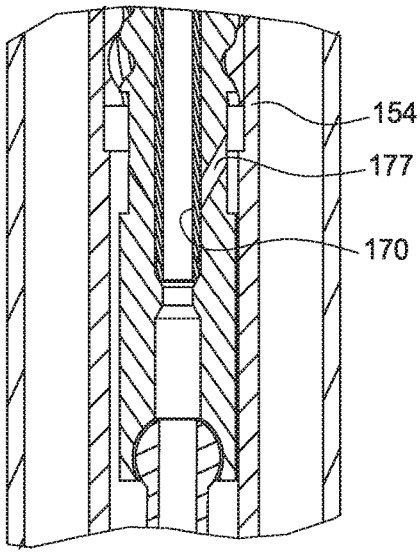

Referring to FIG. 19, after drilling is completed, a ball 178 can be dropped to alter the flow path through the motor 50 for cementing purposes. The ball 178 seats in the entry port 174 of the power section 158 and effectively blocks the fluid path to the power section 158. As pressure is increased in FIG. 20, the "weaker" shear screws 172 connecting the flow tube 170 to the rotor 153 are sheared out, thereby shifting the tube 170 downward. This downward movement causes the flow tube 170 to seal off the entry ports 174 to the power section 158. This downward movement also causes the flow tube 170 to seal off the exit ports 177 from the power section 158, as shown in FIG. 21. As a result, fluid and cement can no longer enter the power section 158. This blockage protects the expensive power section 158 from being damaged as a result of hardened cement.

Figures 22, 22A:
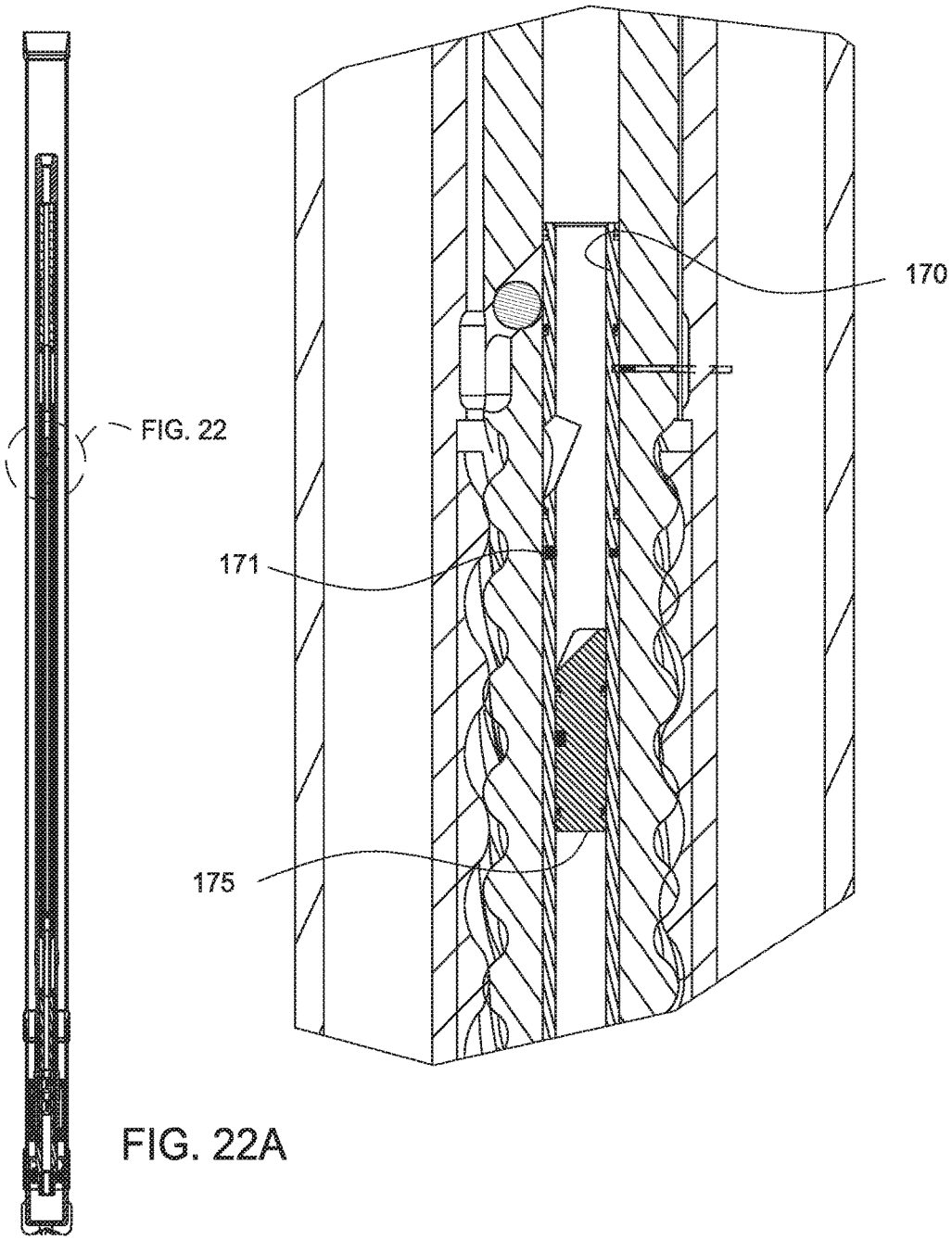
Figure 23:
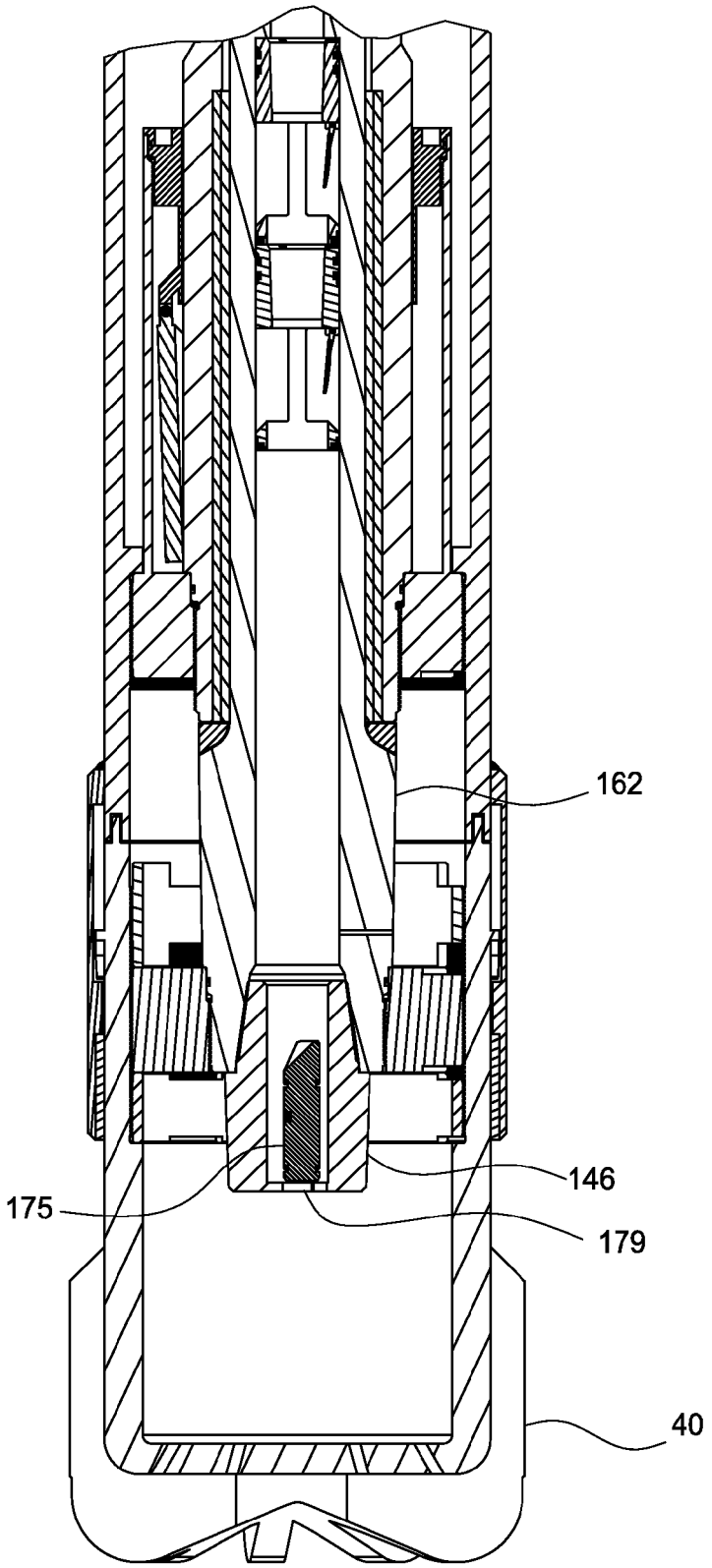
Figure 24:
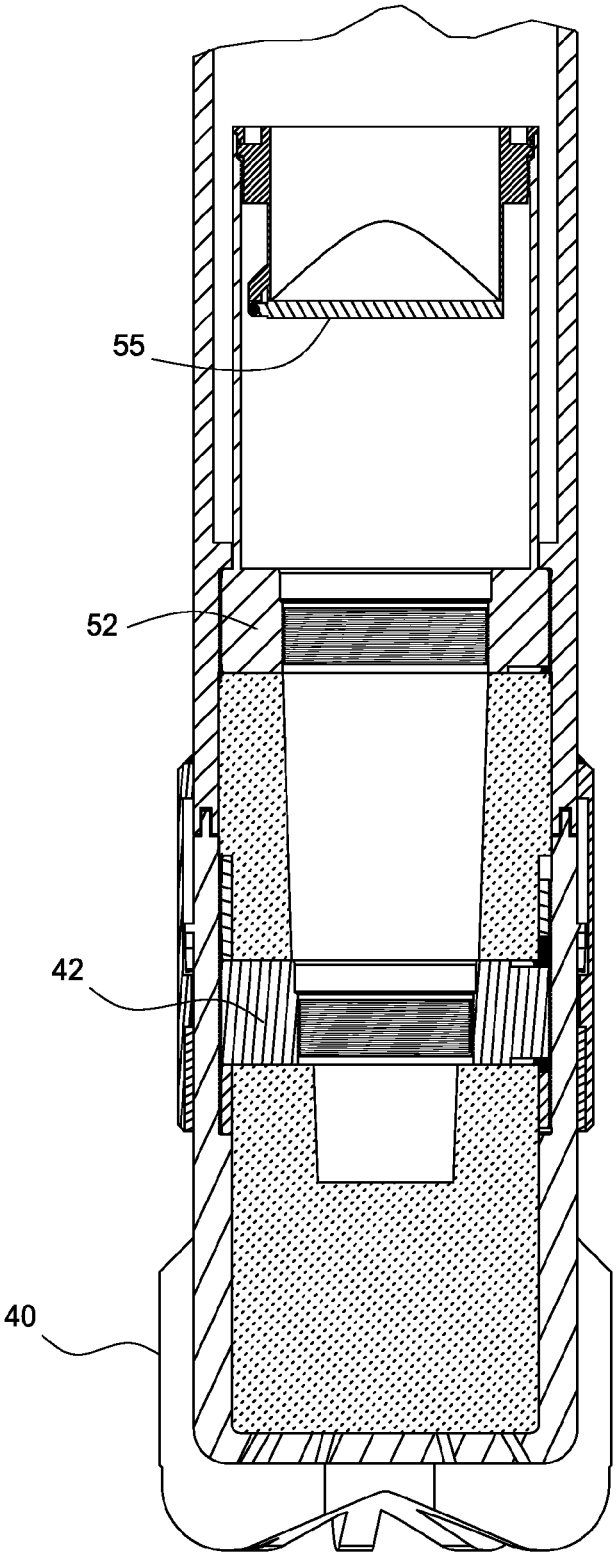
FIG. 24 shows the motor removed from the bit drive assembly of FIG. 11.

After the tube 170 has shifted downward, the pressure can be further increased in order to shear out the "stronger" shear screw(s) 171 that retains the diverter piston 175 against the flow tube 170, as shown in FIG. 22. The diverter piston 175 is then forced though the tube 170, and out of the motor 50. The stop sub 146 below the motor 50 traps the diverter piston 175 as it exits the motor 50, shown in FIG. 23. One or more holes 179 in the stop sub 146 allow fluid and cement to pass through while keeping the diverter piston 175 trapped. An open circulation path is now available for cementing, while the power section 158 remains sealed from fluid flow. FIG. 24 shows the casing bit assembly after cementing. The motor 50 has been removed by pulling up and shearing from the thread couplings 42, 52. Also, the flapper float valve 55 has closed after removal of the motor 50.

Figure 25:
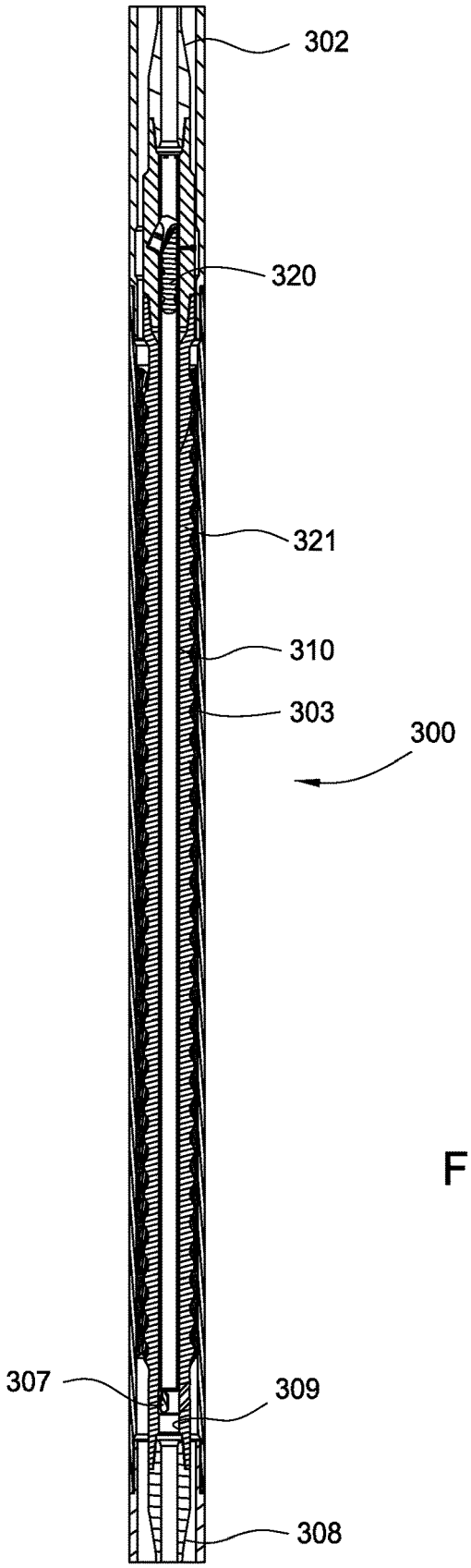
FIGS. 25 and 26 illustrate another embodiment of the motor assembly.
Figure 26:
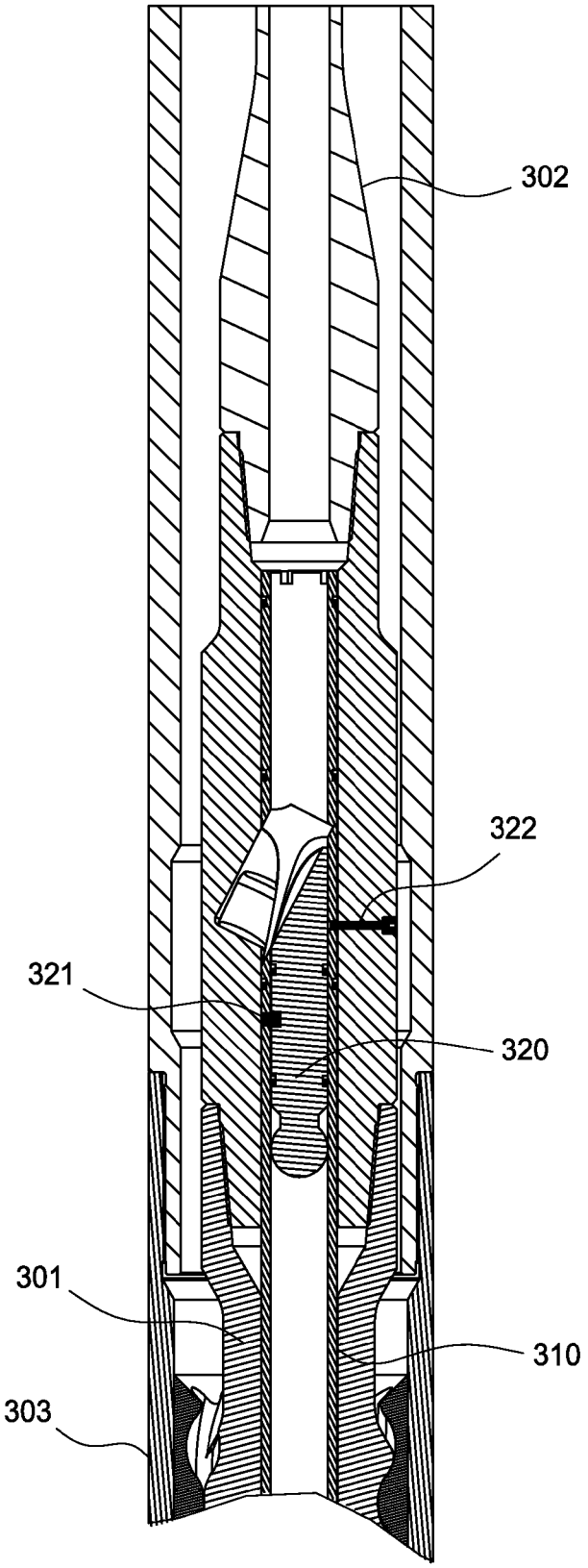

FIGS. 25 and 26 illustrate another embodiment of the motor assembly 300. FIG. 26 is an enlarged, partial view of FIG. 25. The top of the motor assembly 300 is connected to the inner string 302. As discussed above, the upper portion of the rotor 301 is coupled to the stator 303 using axial and radial bearings. An optional upper flex shaft couples the bearing section to the power section of the rotor 301. The power section of the rotor 301 has a hollow bore 309 (also shown in FIG. 33B) extending therethrough. Referring to FIG. 26, a flow tube 310 and a diverter piston 320 are disposed in the bore 309. The diverter piston 320 is held in the flow tube 310 using a first shearable member 321 and blocks fluid flow through the flow tube 310. The flow tube 310 is held in the bore 309 using a second shearable member 322. The second shearable member 322 is configured to shear at a lower force than the first shearable member 321. In one embodiment, the flow tube 310 may extend down the bore 309 to a location above the re-entry port 307.

Figure 27:
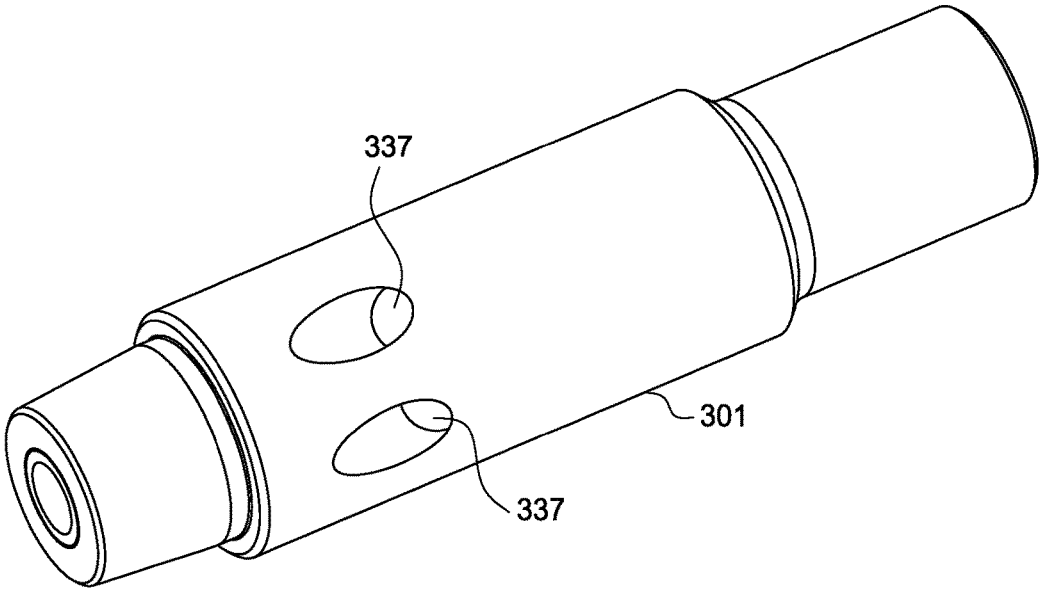
FIG. 27 is a perspective view of an embodiment of the rotor of the motor assembly of FIG. 25.
Figure 28A:
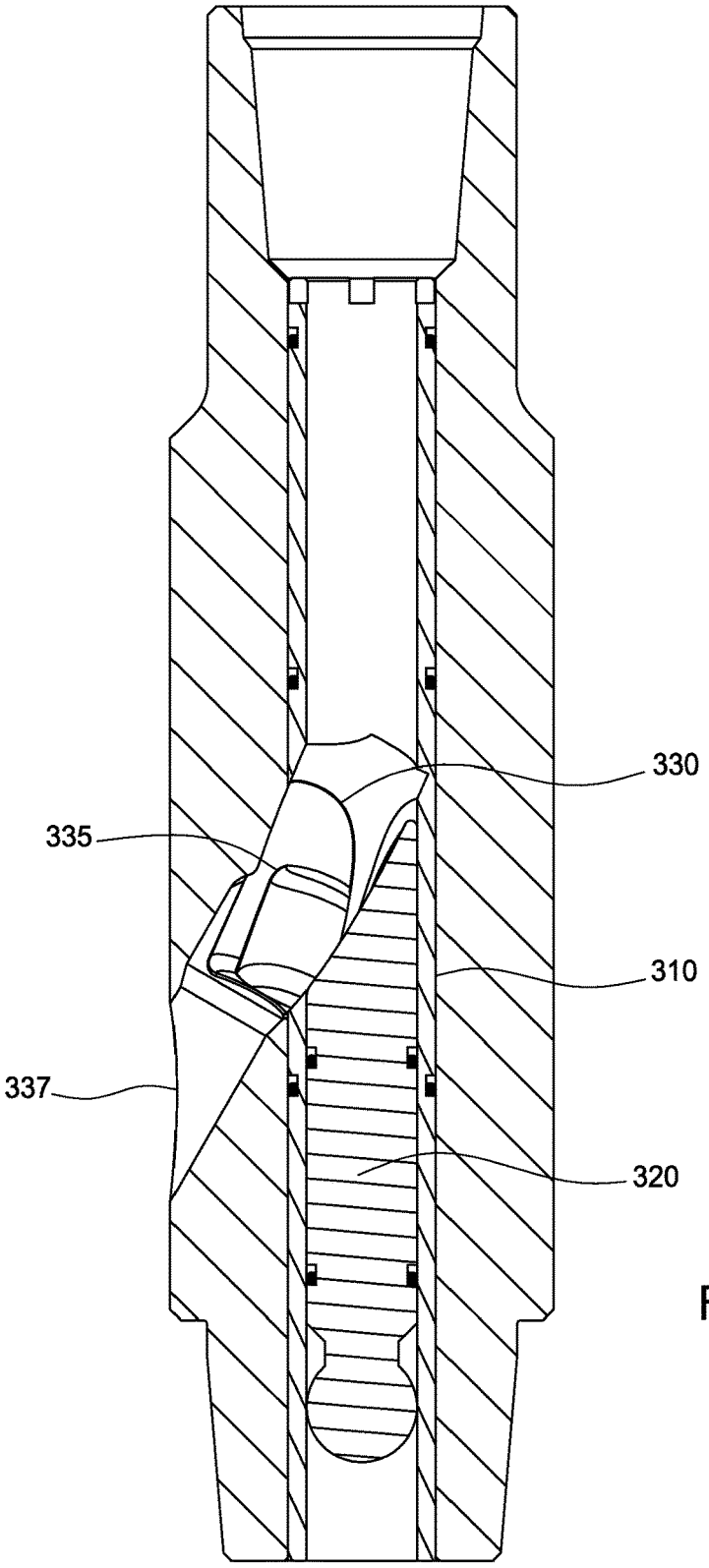
FIGS. 28A-E are different partial cross-sectional views of the upper portion of the motor assembly of FIG. 25.
Figure 28B:
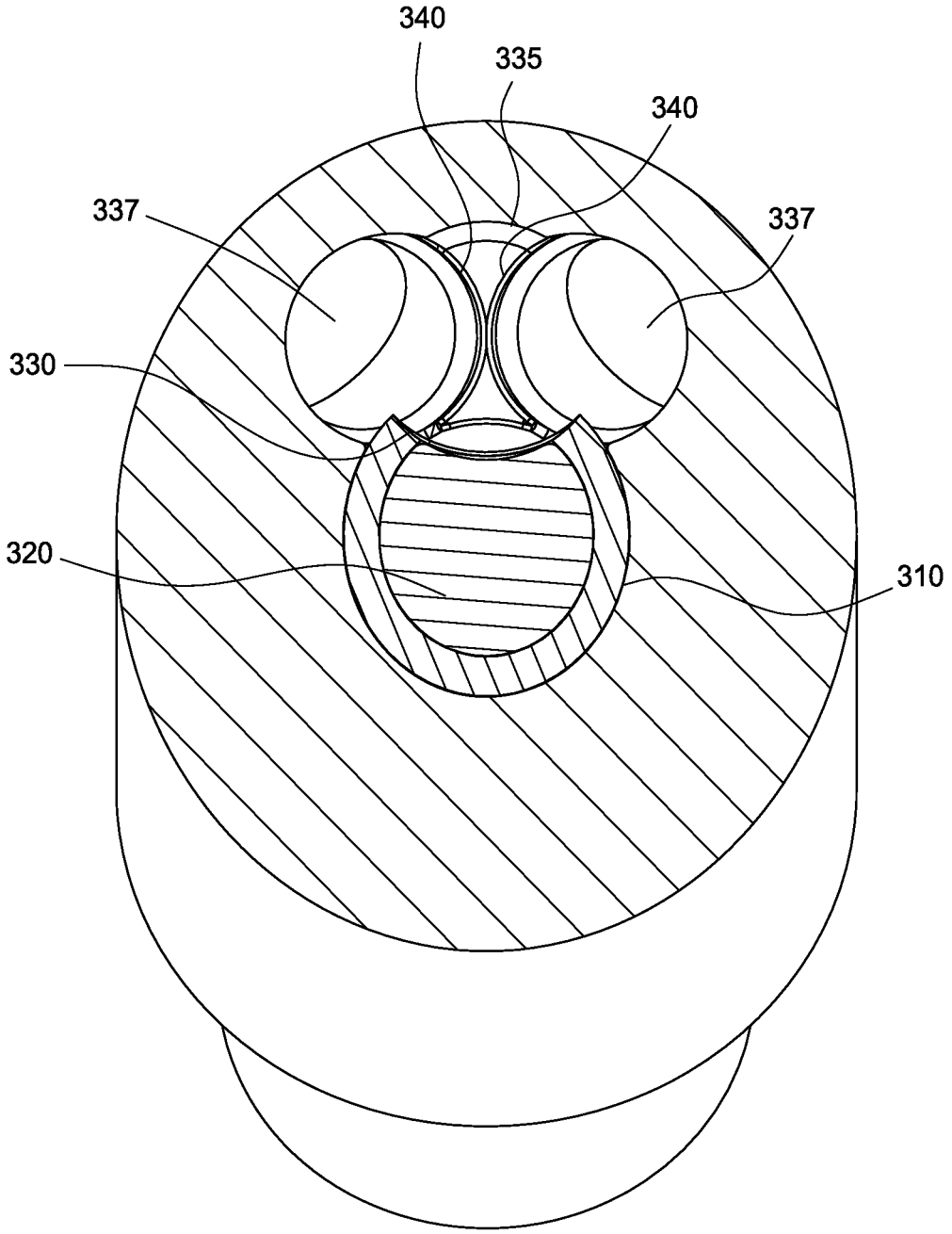
Figure 28C:
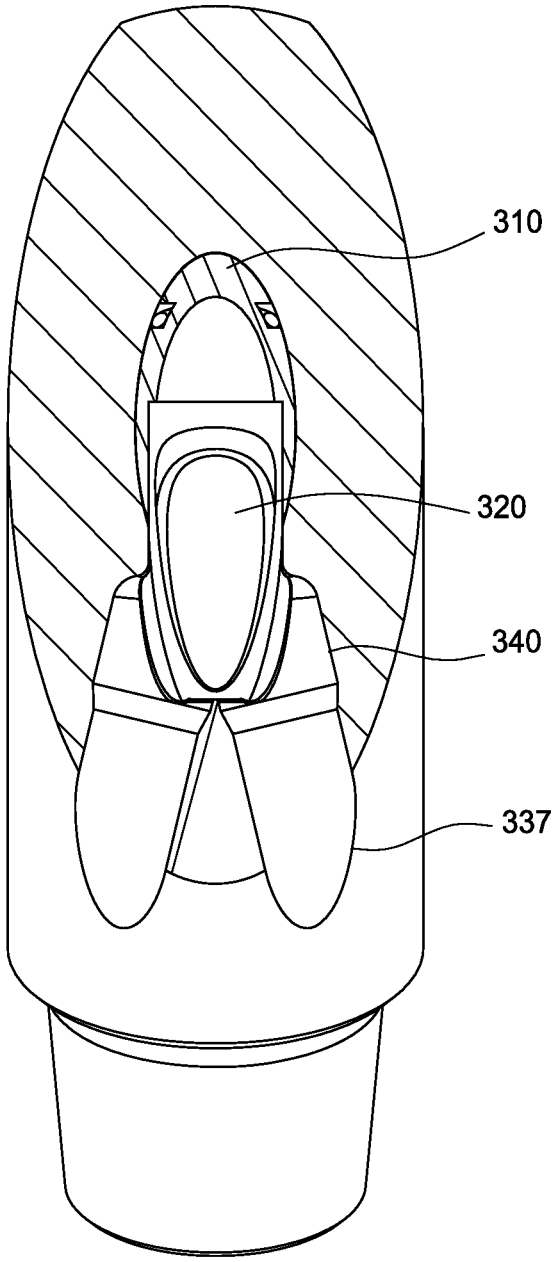
Figure 28D:
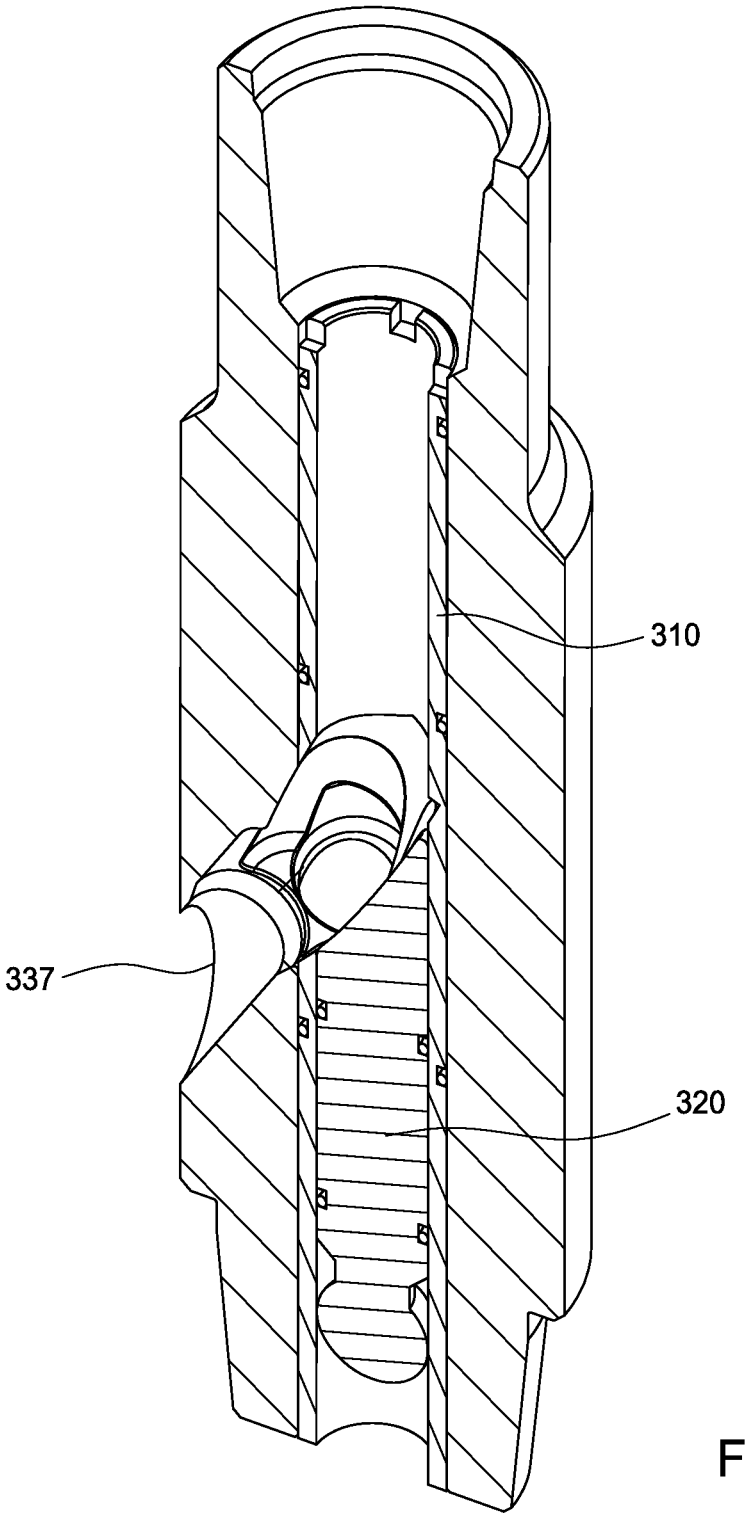
Figure 28E:
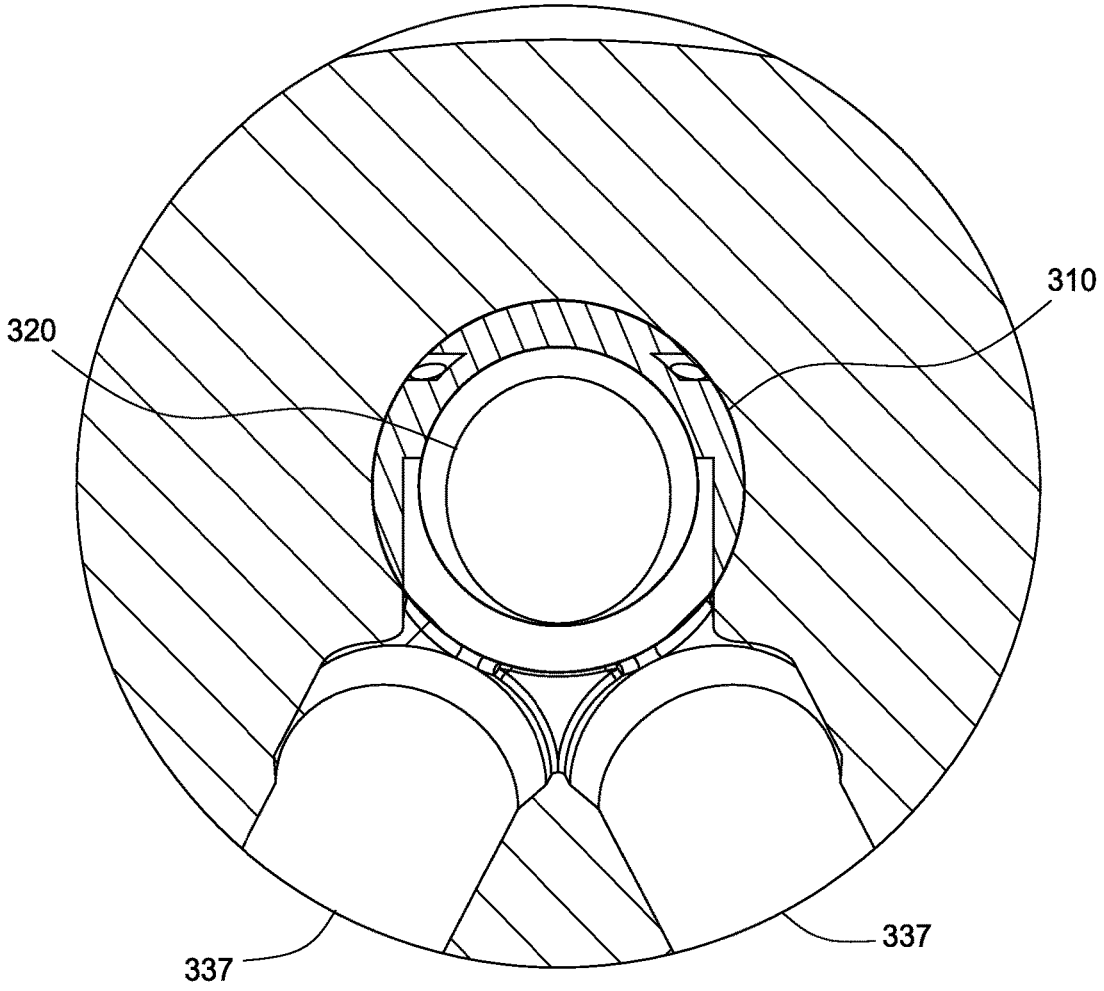

The flow tube 310 includes one or more ports 330 initially aligned with entry ports 335 in the rotor 301, as shown in FIGS. 28A-E. FIGS. 28A-E are different partial cross-sectional views of the upper portion of the motor assembly 300. Each entry port 335 may include a plurality of exits ports 337, such as 2, 3, 4, or more exit ports. FIG. 27 is a perspective view of an embodiment of the rotor 301 having two exit ports 337. Referring back to FIGS. 28A-E, the entry ports 335 are in fluid communication with the two exit ports 337. Each of the exit ports 337 includes a seat 340 for receiving a ball or other suitable object to block fluid communication through the respective exit ports 337. In one embodiment, the seats 340 are configured so that after the first ball lands in one of the seats 340, the first ball will help guide the second ball into the other seat 340. The plurality of exit ports 337 provide a larger total flow area, thereby reducing the fluid velocity through the exit ports 337. In this respect, the reduced fluid velocity may help limit erosion of the ball seats 340. In one embodiment, the total flow area of the exit ports 337 are more than the total flow area of the entry port 335.

FIGS. 28A-E show the motor assembly 300 in drilling mode. In drilling mode, the drilling fluid enters the top of the drilling motor. The fluid may flow down the flow tube 310 directed through the port 330 of the flow tube 310 by the diverter piston 320, which prevents fluid from travelling down through the bore of the flow tube 310. The fluid may then flow out of the exit ports 337 and enter the top portion of the power section between the outer diameter of the rotor 301 and the inner diameter of the stator 303. This fluid provides power to cause rotation of the rotor 301 relative to the stator 303. As shown in FIG. 25, at the lower end of the power section, fluid flow can exit the power section and re-enter the bore 309 via the re-entry port 307 to continue flowing downward to the motor output shaft. The lower end of the rotor 301 also includes an optional lower flex shaft 308 to facilitate transfer of torque to the output shaft and includes axial and radial bearings.

Figure 29A:
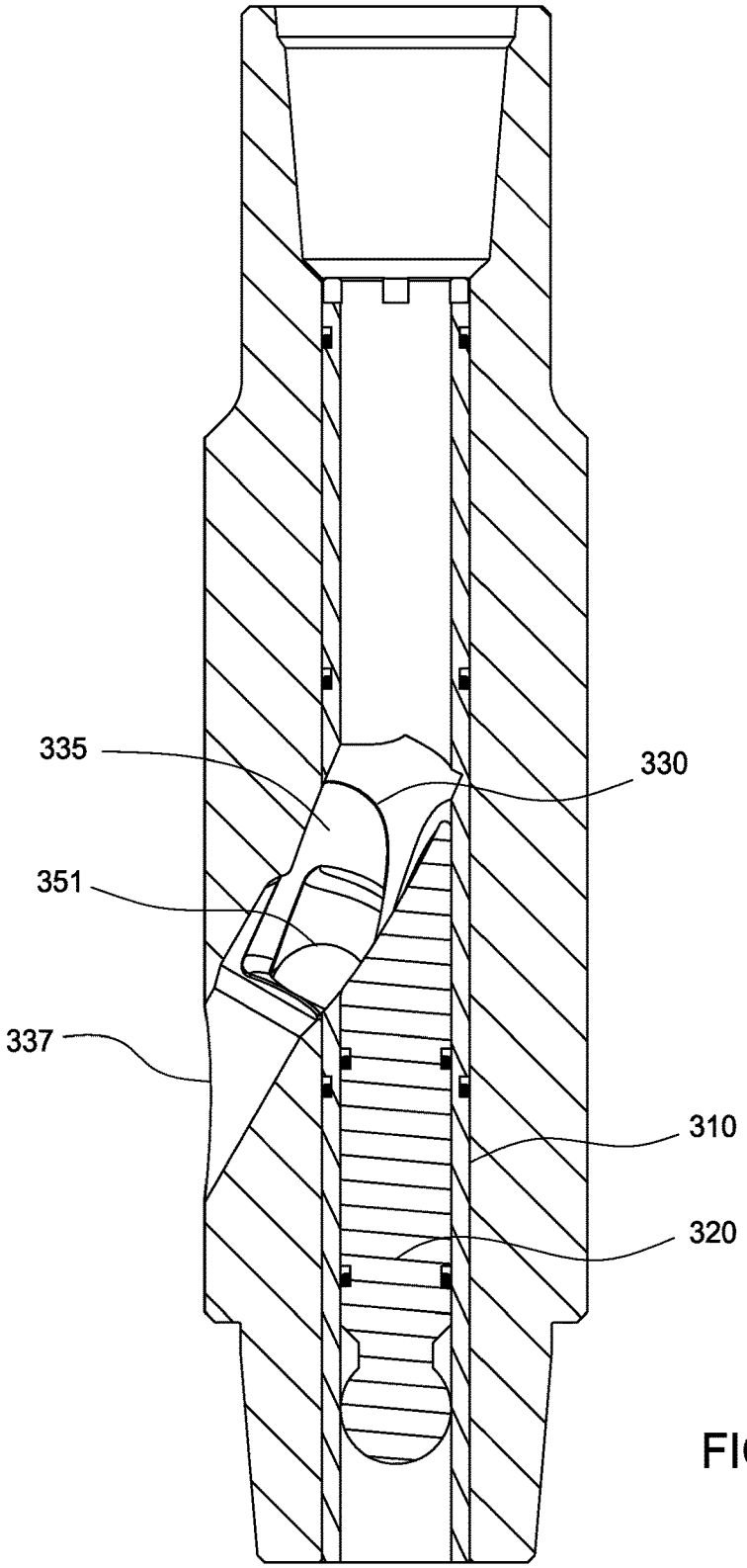
FIGS. 29A-E are different partial cross-sectional views of the upper portion of the motor assembly of FIG. 25 after one ball has landed.
Figure 29B:
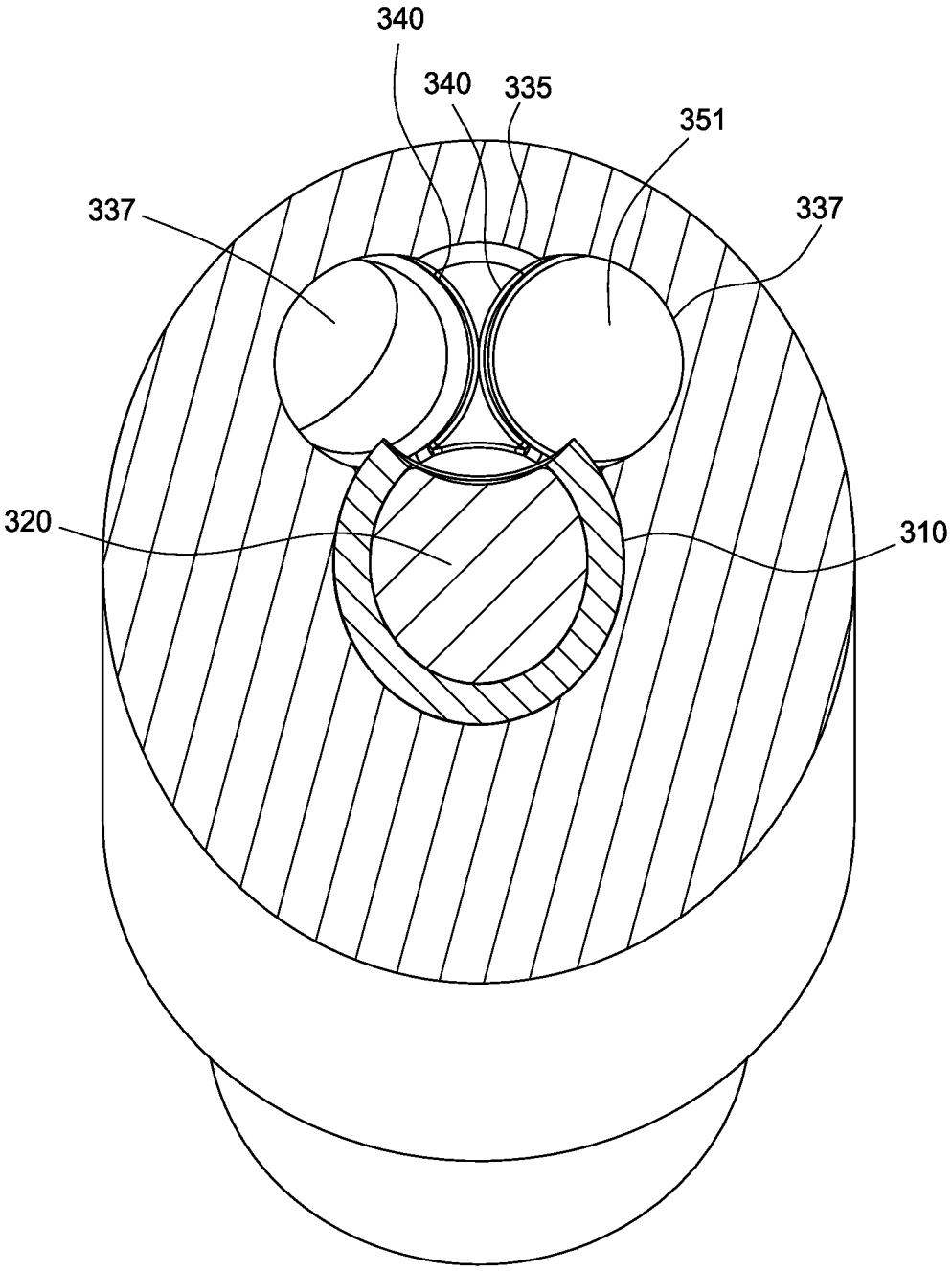
Figure 29C:
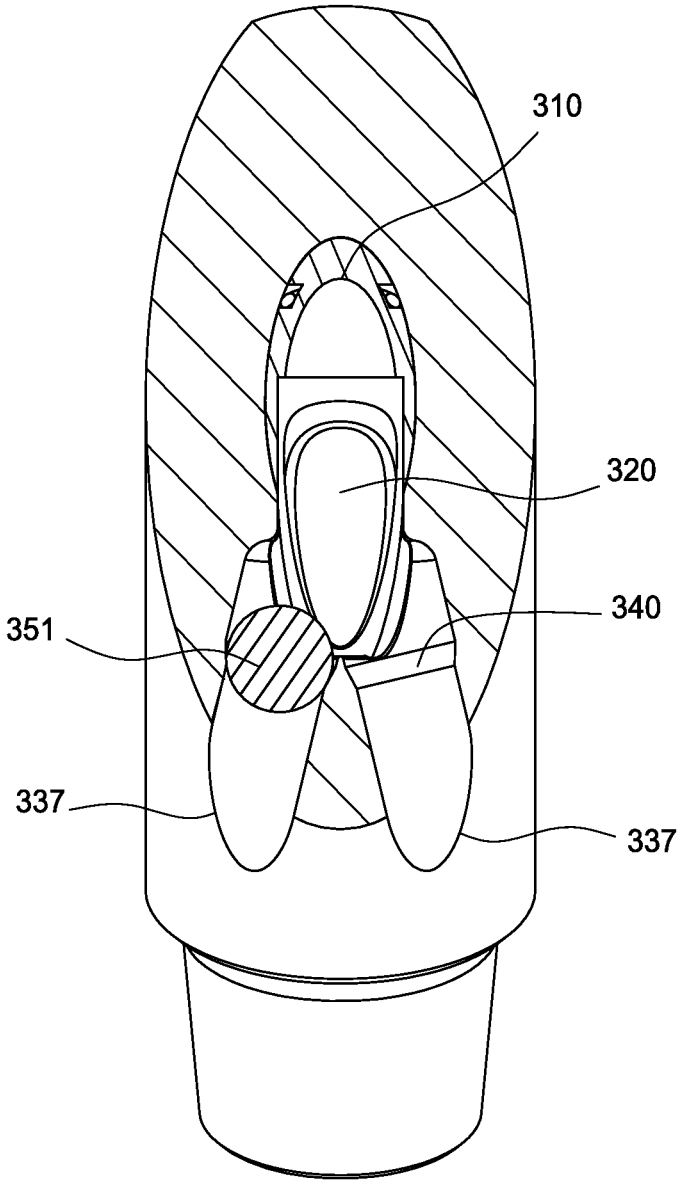
Figure 29D:
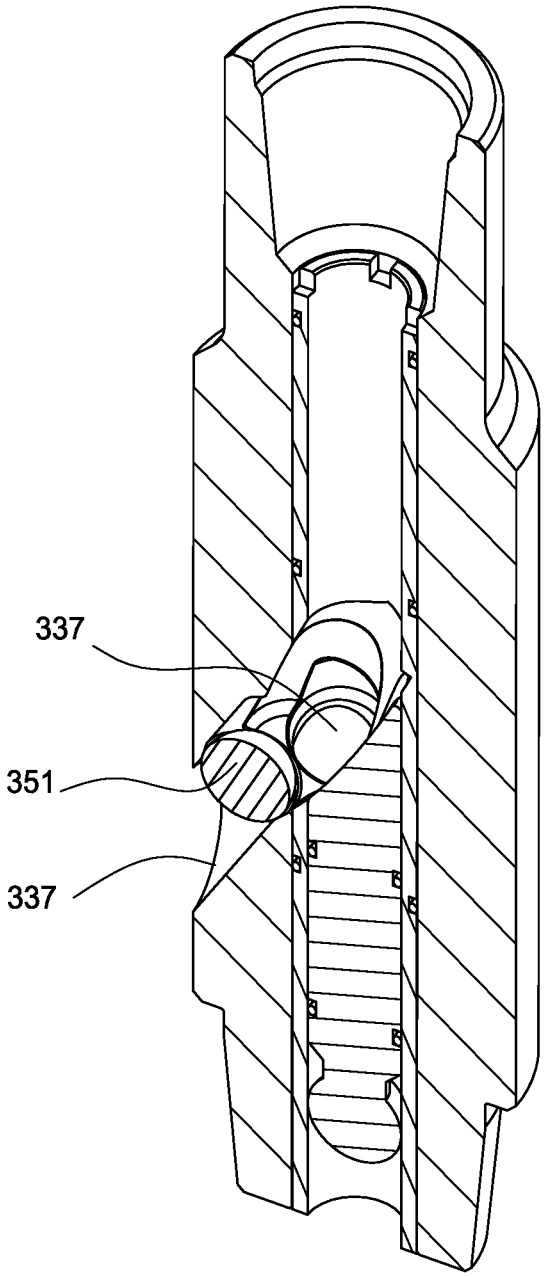
Figure 29E:
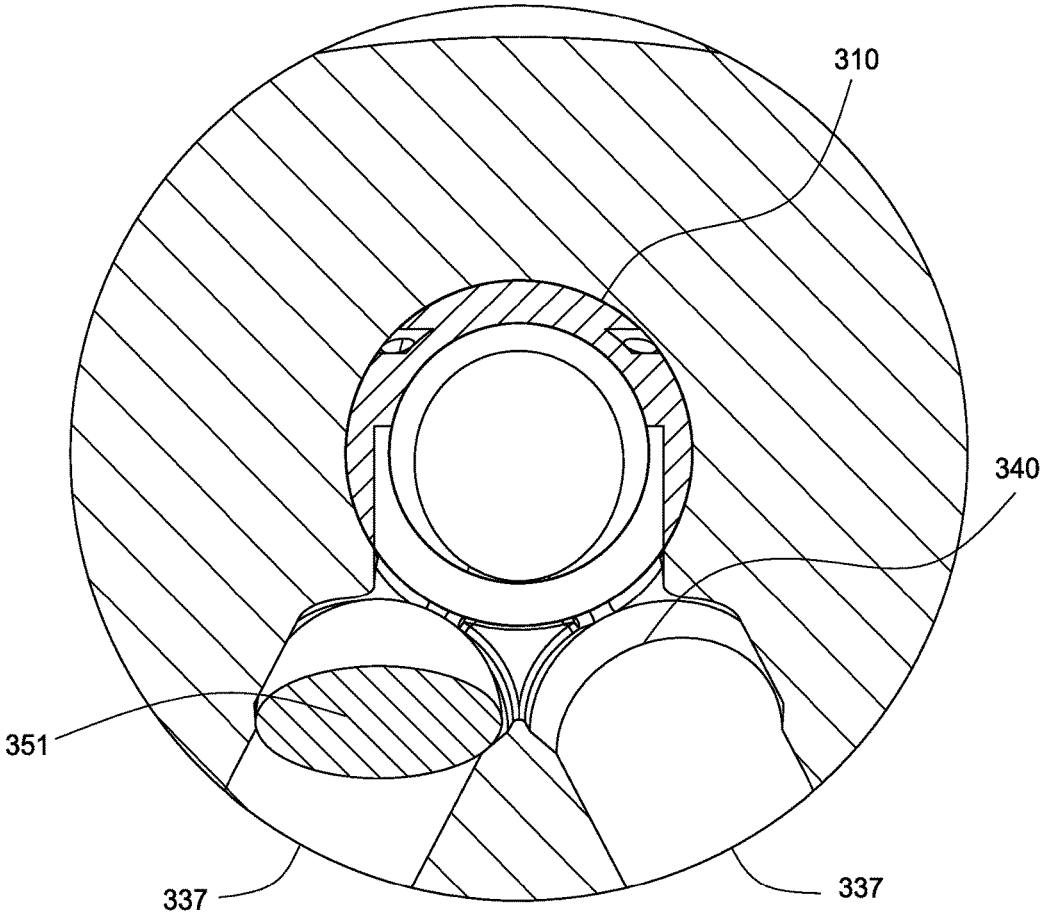
Figure 30A:
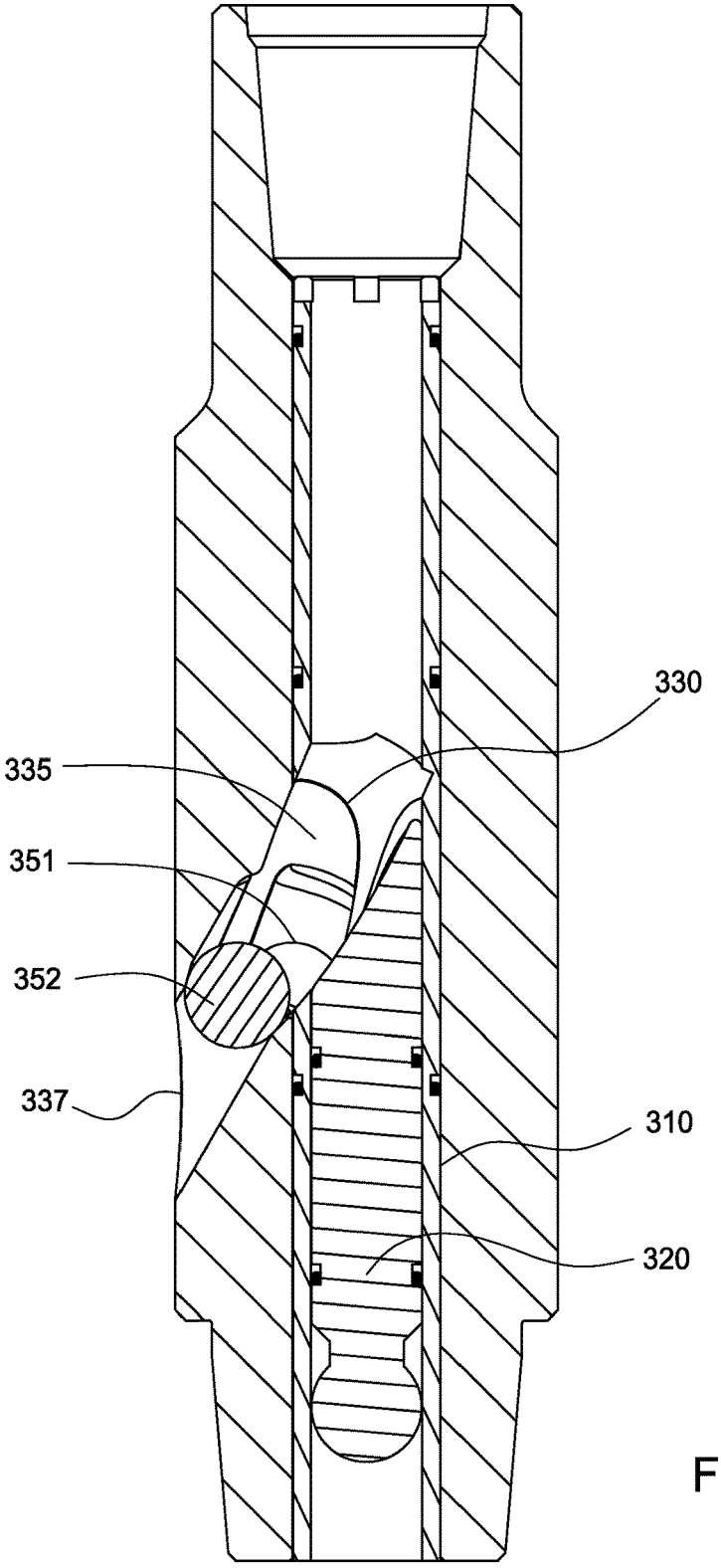
FIGS. 30A-E are different partial cross-sectional views of the upper portion of the motor assembly of FIG. 25 after two balls have landed.
Figure 30B:
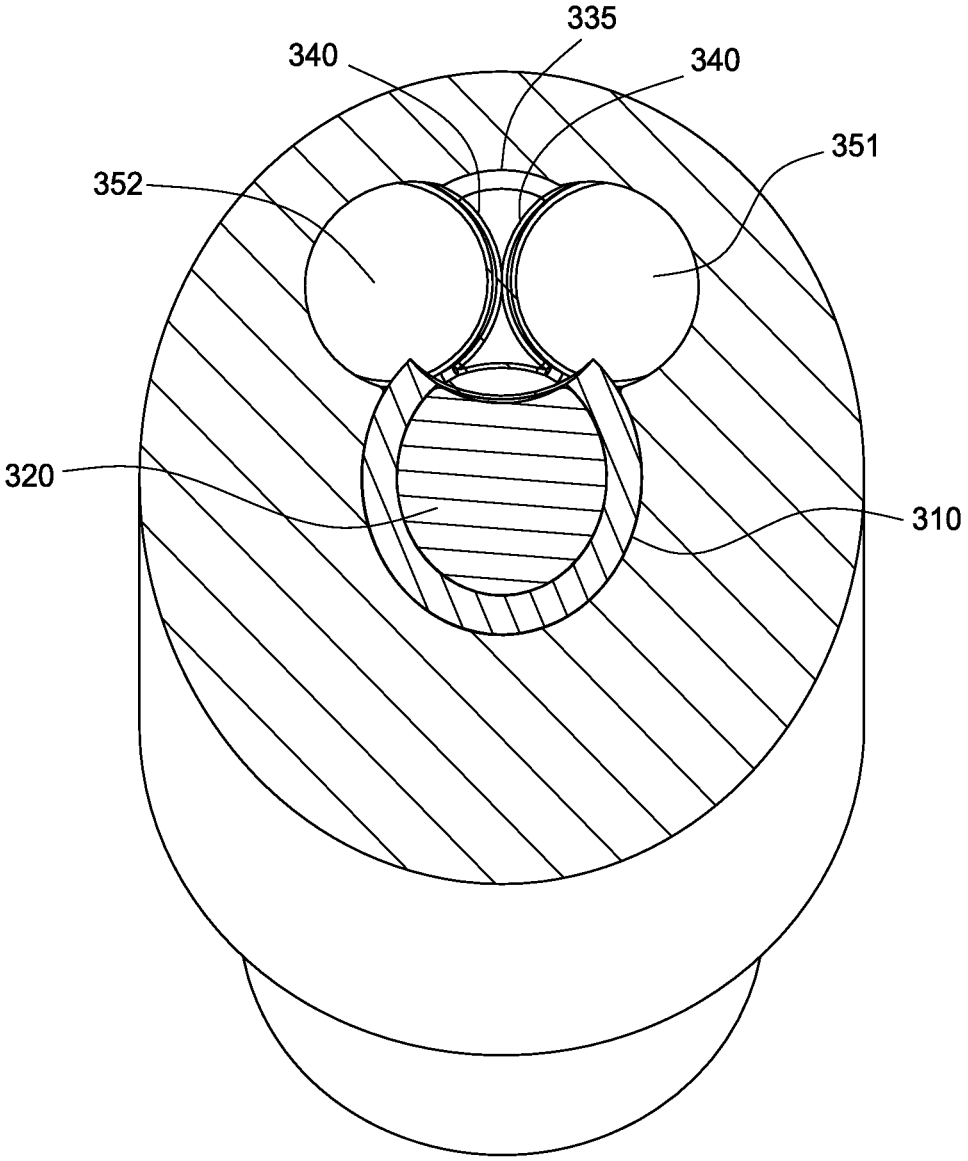
Figure 30C:
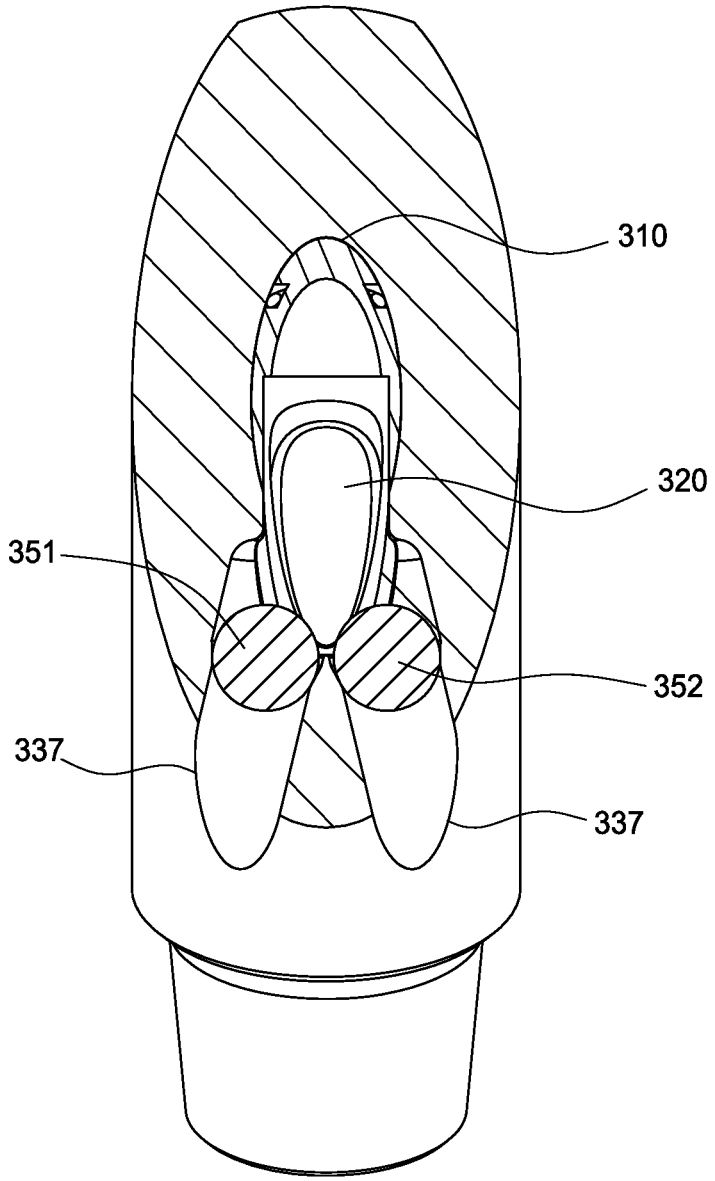
Figure 30D:
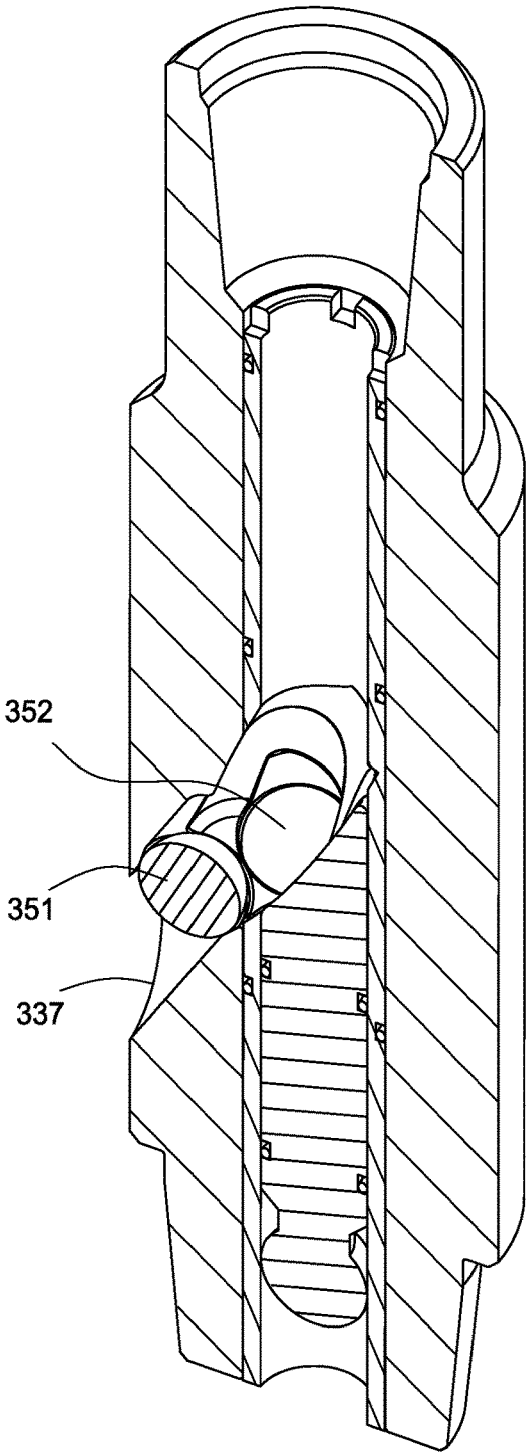
Figure 30E:
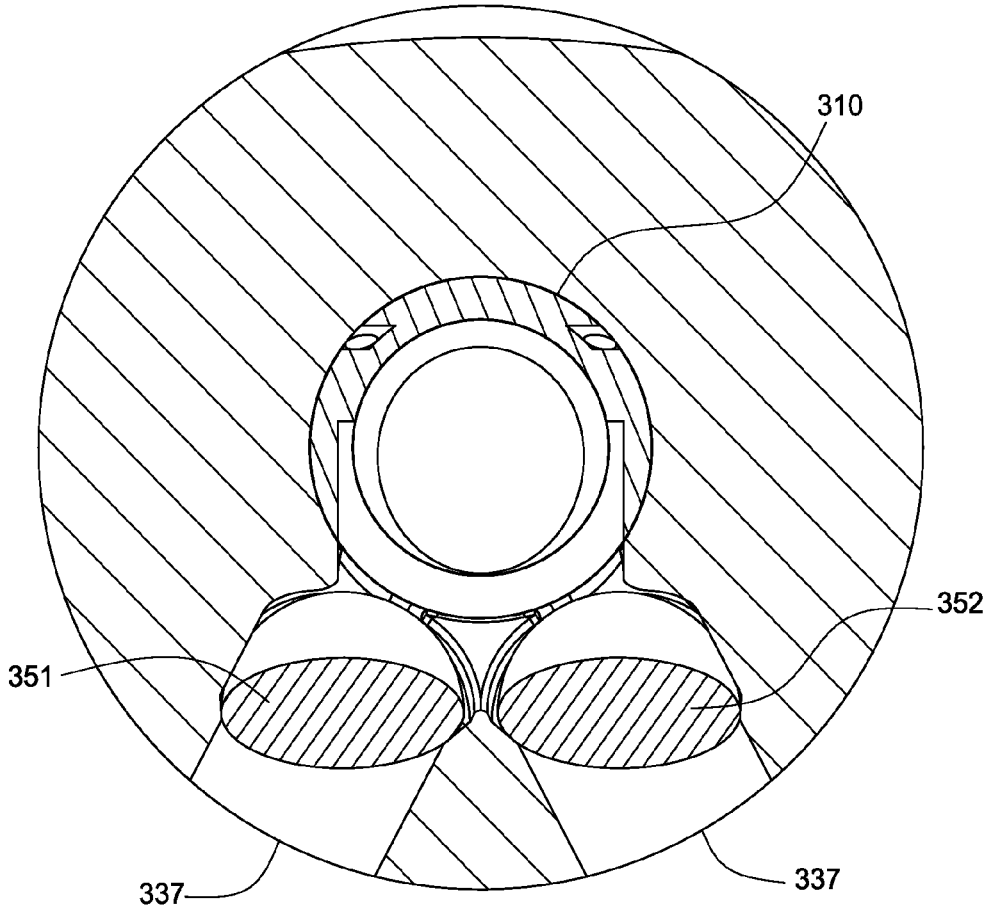

After drilling is completed, a plurality of balls 351, 352 can be dropped to alter the flow path through the motor for cementing purposes. FIGS. 29A-E are different partial cross-sectional views of the upper portion of the motor assembly 300 with a ball 351 in one of the seats 340. As shown, a first ball 351 is dropped to block one of the exit ports 337. The first ball 351 may travel down the flow tube 310 and be directed through the port 330 of the flow tube 310 by the diverter piston 320. The first ball 351 enters the entry port 335 and lands in the seat 340 of one of the exit ports 337. As shown in FIG. 29B, the first ball 351 lands in the seat 340 on the right exit port 337. It must be noted that the first ball 351 may land in the seat 340 of either exit port 337.

A second ball 352 is dropped to block the unoccupied seat 340 in the other exit port 337. Referring now to FIGS. 30A-E, after the second ball 352 enters the entry port 335, it may contact the first ball 351, and be directed to the unoccupied seat 340. In one embodiment, after landing in the seat 340, the first ball 351 protrudes above the unoccupied ball seat 340 so that it can direct the second ball 352 to the empty seat 340. FIGS. 30A-E shows both of the balls 351, 352 landed in the seats 340 of the exit ports 337.

Figure 31A:
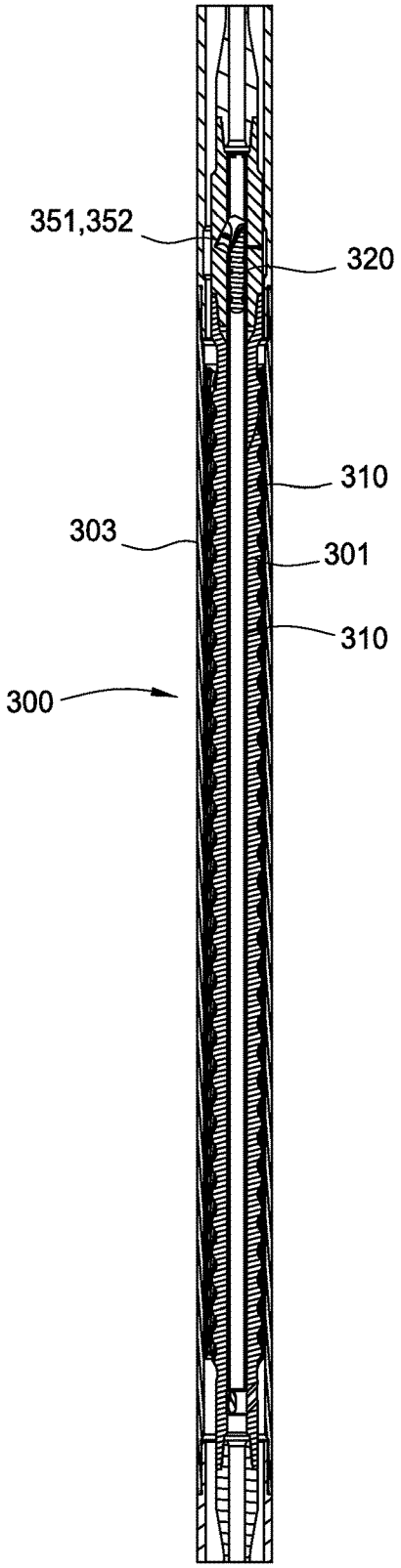
FIGS. 31A-B show the motor assembly of FIG. 25 after both balls have landed.
Figure 31B:
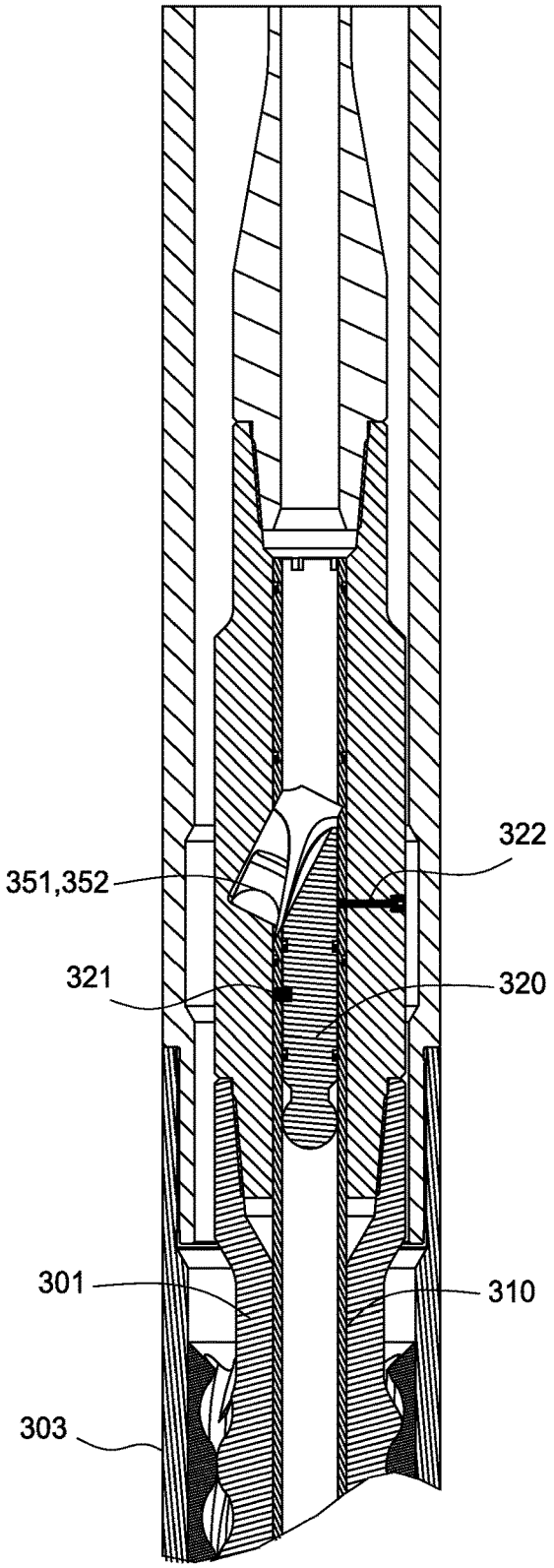
Figure 32A:
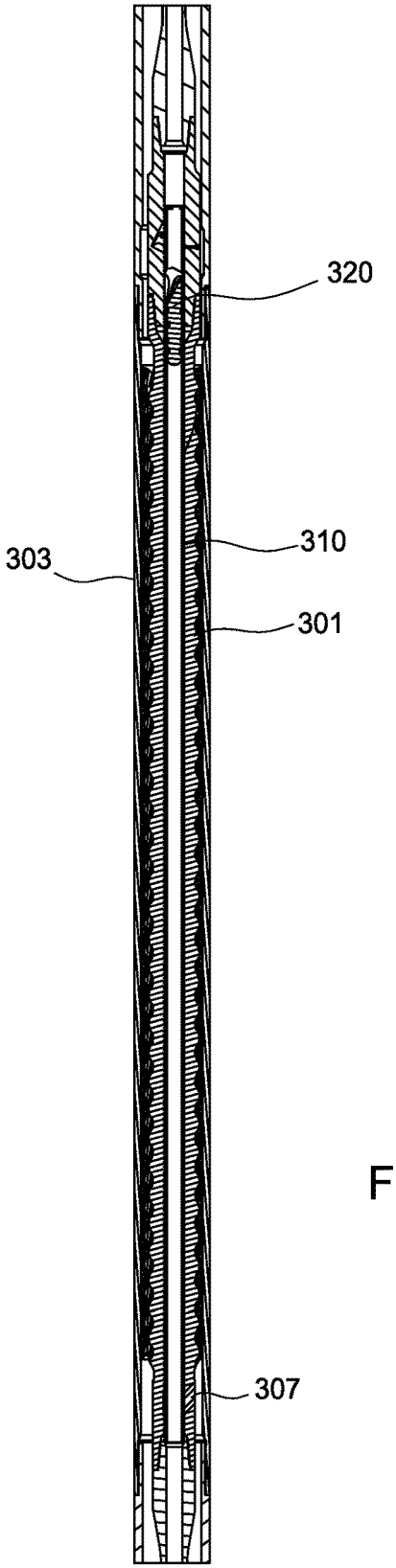
FIGS. 32A-B show the motor assembly of FIG. 25 after the flow tube has shifted.
Figure 32B:
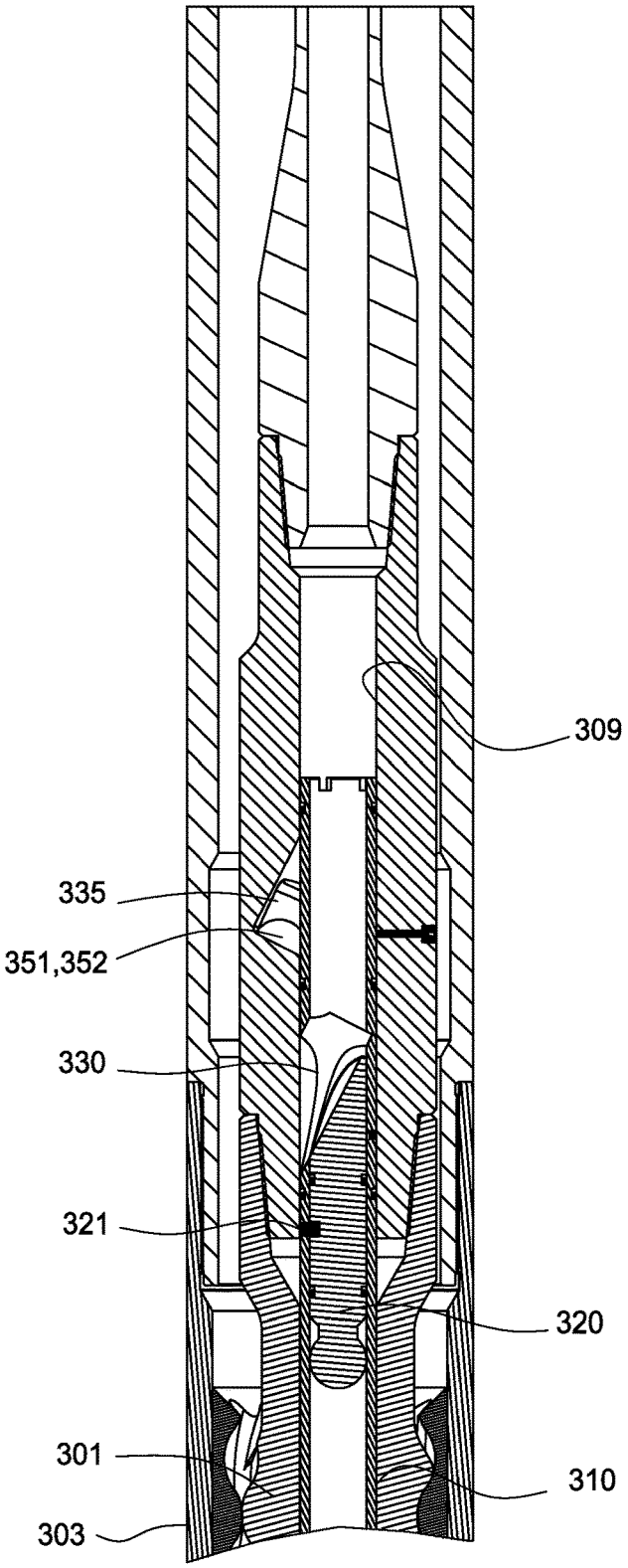

After the balls 351, 352 land in the seats 340 in the exit ports 337, the balls 351, 352 effectively block the fluid path to the power section. FIGS. 31A-B show the motor assembly 300 after both balls 351, 352 have landed. FIG. 31B is an enlarged, partial view of FIG. 31A. Pressure is then increased in the flow tube 310 above the diverter piston 320. When a predetermined pressure is reached, the second shearable member 322 connecting the flow tube 310 to the rotor 301 is sheared out, thereby allowing the flow tube 310 to shift down, as illustrated in FIGS. 32A-B. FIG. 32B is an enlarged, partial view of FIG. 32A. This downward shift moves the port 330 of the flow tube 310 out of alignment with the entry port 335. After shifting, the flow tube 310 seals off the port 330 of the flow tube 310 and the entry port 335 of the rotor 301, as shown in FIG. 32B. As a result, fluid and cement can no longer enter the power section. Additionally, when the tube 310 shifts down, the tube 310 also blocks the re-entry ports 307 at the bottom of the rotor 301. Closing the re-entry ports 307 prevent the cement from flowing upward into the power section and downward into the lower sealed bearing pack. This blockage protects the expensive power section from being damaged as a result of hardened cement.

Figure 33A:
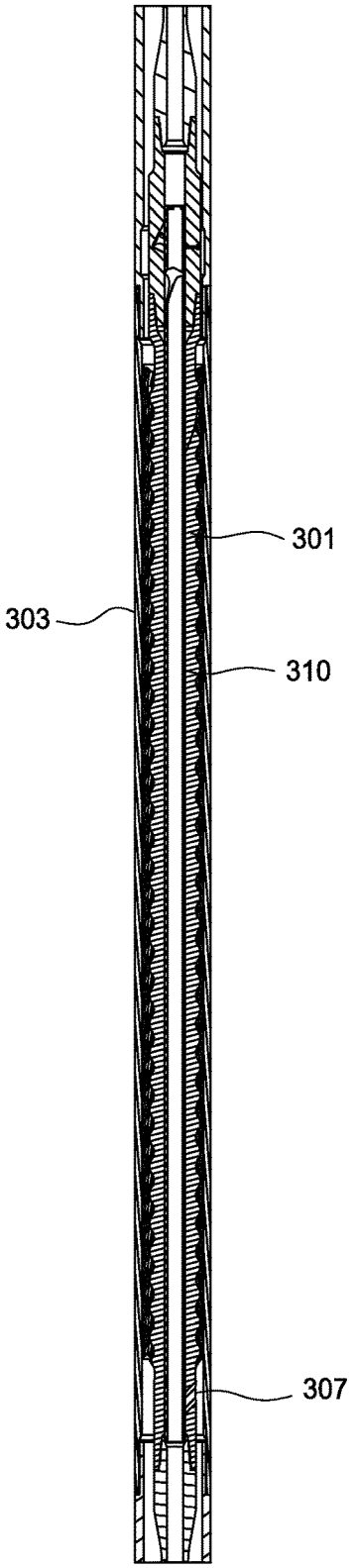
FIGS. 33A-B show the flow tube of the motor assembly of FIG. 25 after the diverter piston has been removed.
Figure 33B:
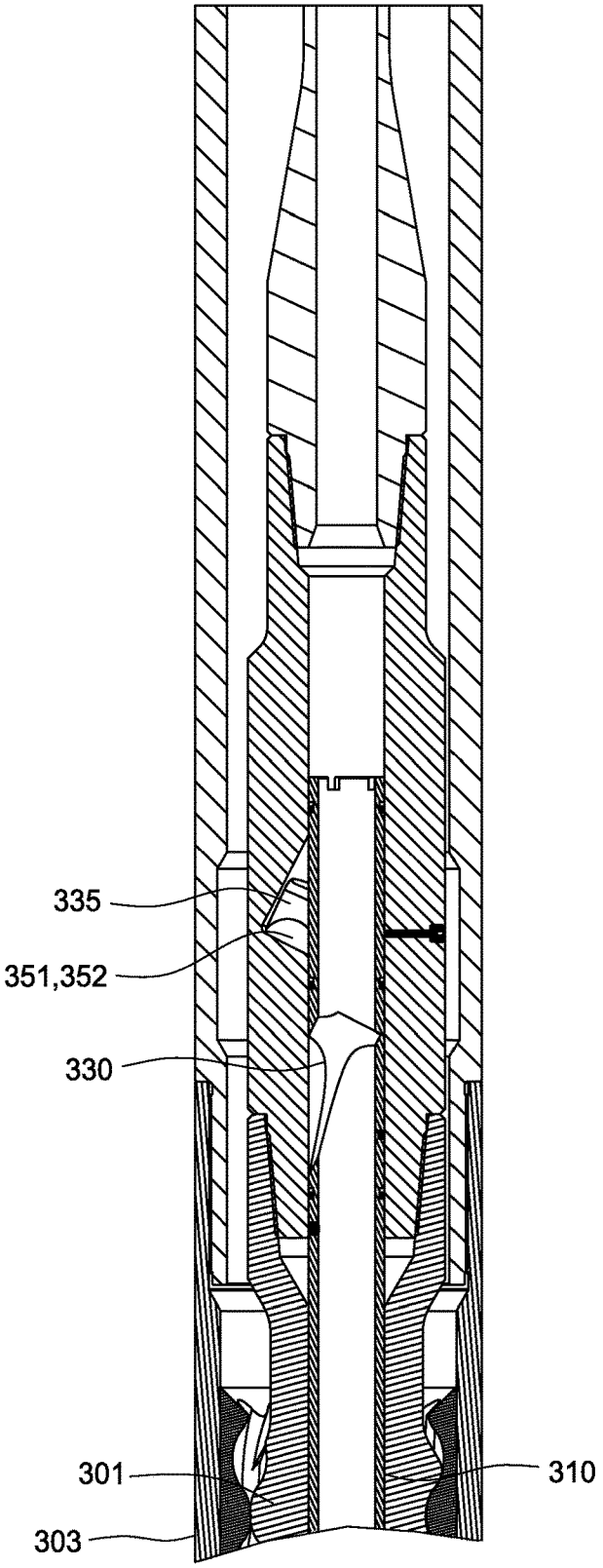

After the flow tube 310 has shifted downward, the pressure can be further increased in order to shear out the "stronger," second shear screw(s) 321 that retains the diverter piston 320 against the flow tube 310. The diverter piston 320 is then forced though the flow tube 310, and out of the motor. FIGS. 33A-B show the flow tube 310 after the diverter piston 320 has been removed. FIG. 33B is an enlarged, partial view of FIG. 33A.

The stop sub below the motor traps the diverter piston 320 as it exits the motor, shown in FIG. 23 above. One or more holes in the stop sub allow fluid and cement to pass through while keeping the diverter piston 320 trapped. An open circulation path is now available for cementing, while the power section remains sealed from fluid flow.

Although the multiple exit ports are described with reference to casing drilling, it is contemplated that the multiple exit ports may be used applications where a reduced fluid velocity is desired.

It is contemplated that embodiments disclosed in the application may be used with any concepts described in the '676 application, and vice versa. For example, the multiple exit ports concept described with respect to FIGS. 25-33 may be used with the embodiments of the fourth concept described in the '676 application.

While the foregoing is directed to embodiments of the present invention, other and further embodiments of the invention may be devised without departing from the basic scope thereof, and the scope thereof is determined by the claims that follow.

The invention claimed is:

1. A ball seat assembly, comprising:

a tubular having a bore therethrough;

an entry port in fluid communication with the bore;

a plurality of exit ports in fluid communication with the entry port;

a ball seat disposed in each of the plurality of exit ports, wherein the ball seat is configured to receive a ball to block fluid flow through the respective exit port and wherein the ball seat is configured so that the ball occupying the ball seat is situated to guide a next ball to land in an unoccupied ball seat; and a diverter configured to block fluid flow through the bore and direct fluid flow from the bore to the entry port.

2. The ball seat assembly of claim 1, wherein the total flow area of the plurality of exit ports is more than the flow area of the entry port.

3. The ball seat assembly of claim 1, further comprising a flow tube disposed in the bore, wherein the flow tube includes a tube port for communicating with the entry port.

4. The ball seat assembly of claim 3, wherein the diverter is disposed in the flow tube.

5. The ball seat assembly of claim 4, wherein the flow tube is selectively connected to the tubular.

6. The ball seat assembly of claim 5, wherein the diverter is selectively connected to the flow tube.

7. The ball seat assembly of claim 1, wherein the entry port is formed in a wall of the tubular.

8. The ball seat assembly of claim 1, wherein the diverter is releasable from the tubular to allow fluid flow through the bore.

9. An apparatus for controlling fluid flow through a tubular, comprising:

the tubular having a bore therethrough;

an inlet in fluid communication with the bore;

a plurality of outlets in fluid communication with the inlet;

a flow tube disposed in the bore, wherein the flow tube includes a tube port for communicating with the inlet;

a flow tube disposed in the bore and releasably connected to the tubular, wherein the flow tube includes a tube port for communicating with the inlet and wherein the flow tube is releasable from the tubular to close communication between the tube port and the inlet; and a diverter releasably connected to the tubular and configured to block fluid flow through the bore and direct fluid flow through the inlet, wherein the total flow area of the plurality of outlets is more than the flow area of the inlet, wherein the diverter is releasable from the tubular to allow fluid flow through the bore.

10. The apparatus of claim 9, wherein the inlet is formed in a wall of the tubular.

11. A method of controlling fluid flow through a tubular, comprising:

flowing a fluid through a bore of the tubular;

directing the fluid in the bore to flow through an entry port;

flowing the fluid out of the entry port through a plurality of exit ports; and blocking flow through each of the plurality of exit ports by landing a ball in each of the plurality of exit ports, thereby blocking fluid communication through the entry port.

12. The method of claim 11, further comprising opening the bore for fluid flow after blocking each of the plurality of exit ports.

13. The method of claim 11, wherein each of the plurality of exit ports are sequentially blocked.

14. The method of claim 11, further comprising guiding a second ball into an un-occupied exit port.

15. A method of operating a motor assembly having a power section, comprising:

flowing a fluid through a bore of the power section;

blocking fluid flow through the bore to cause the fluid in the bore to flow through an entry port;

flowing the fluid out of the entry port through a plurality of exit ports; and operating the power section using the fluid from the plurality of exit ports.

16. The method of claim 15, further comprising:

blocking fluid flow through each of the plurality of exit ports;

increasing pressure to open the bore for fluid flow therethrough.

17. The method of claim 16, wherein blocking each of the plurality of exit ports comprises landing a ball in each of the plurality of exit ports.

18. The method of claim 17, further comprising guiding a second ball into an un-occupied exit port.

19. The method of claim 16, wherein fluid flowing through the bore after opening comprises cement.

20. The method of claim 15, wherein fluid directed into the entry port comprises drilling fluid.

21. The method of claim 15, wherein the entry port is formed in a wall of the tubular.

* * * * *